US007182052B2

(12) United States Patent
Yaoko et al.

(10) Patent No.: US 7,182,052 B2
(45) Date of Patent: Feb. 27, 2007

(54) VALVE TIMING CONTROLLER

(75) Inventors: Seiji Yaoko, Anjo (JP); Jun Yamada, Okazaki (JP); Kinya Takahashi, Obu (JP); Masayasu Ushida, Okazaki (JP); Mitomu Mohri, Kariya (JP); Takao Nojiri, Anjo (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 39 days.

(21) Appl. No.: 11/165,311

(22) Filed: Jun. 24, 2005

(65) Prior Publication Data

US 2005/0284433 A1 Dec. 29, 2005

(30) Foreign Application Priority Data

Jun. 28, 2004 (JP) ..... 2004-189656
Sep. 9, 2004 (JP) ..... 2004-261905

(51) Int. Cl.
*F01L 1/34* (2006.01)

(52) U.S. Cl. ..... 123/90.17; 123/90.15; 123/90.16; 123/90.12; 123/90.31; 92/121; 92/122

(58) Field of Classification Search ..... 123/90.17
See application file for complete search history.

(56) References Cited

U.S. PATENT DOCUMENTS

| | | | | |
|---|---|---|---|---|
| 5,657,725 | A | 8/1997 | Butterfield et al. | 123/90.17 |
| 6,250,265 | B1 * | 6/2001 | Simpson | 123/90.17 |
| 6,481,402 | B1 * | 11/2002 | Simpson et al. | 123/90.17 |
| 6,666,181 | B2 * | 12/2003 | Smith et al. | 123/90.17 |
| 6,763,791 | B2 | 7/2004 | Gardner et al. | 123/90.17 |
| 6,866,013 | B2 * | 3/2005 | Smith | 123/90.17 |

* cited by examiner

*Primary Examiner*—Thomas Denion
*Assistant Examiner*—Kyle M. Riddle
(74) *Attorney, Agent, or Firm*—Nixon & Vanderhye PC

(57) ABSTRACT

A shoe housing receives a driving force from a crankshaft and a vane rotor rotates with a camshaft in combination. The vane rotor is received in the shoe housing in such a way as to freely turn. Each of the vanes of the vane rotor partitions each of three receiving chambers into a retard hydraulic chamber and an advance hydraulic chamber. A check valve is disposed in an advance supply passage. The check valve allows a working oil to flow from an oil pump through the advance supply passage to the advance hydraulic chamber and prohibits the working oil from flowing back from the advance hydraulic chamber through the advance supply passage to a drain.

23 Claims, 24 Drawing Sheets

VALVE TIMING CONTROLLER

CROSS-REFERENCE TO RELATED APPLICATION

This application is based on Japanese Patent Applications No. 2004-189656 filed on Jun. 28, 2004, and No. 2004-261905 filed on Sep. 9, 2004, the disclosure of which is incorporated herein by reference.

FIELD OF THE INVENTION

The present invention relates to a valve timing controller for changing a timing of opening or closing (hereafter referred to as "valve timing") at least either the intake valve or the exhaust valve of an internal combustion engine (hereafter referred to as "engine").

BACKGROUND OF THE INVENTION

Conventionally, there has been known a valve timing controller that includes: a housing for receiving the driving force of the crankshaft of an engine; and a vane rotor received in the housing and transferring the driving force of the crankshaft to a camshaft, and that turns the vane rotor toward a retard side and an advance side with respect to the housing by a working fluid pressure in a retard hydraulic chamber and an advance hydraulic chamber to adjust the phase of the camshaft to the crankshaft, that is, a valve timing.

In the valve timing controller like this, torque variation that the intake valve or the exhaust valve receives from the camshaft when the intake valve or the exhaust valve is opened or closed is transferred to the vane rotor, whereby the vane rotor receives the torque variation on a retard side or an advance side with respect to the housing. When the vane rotor receives the torque variation on the retard side, the working fluid in the advance hydraulic chamber receives force to flow out of the retard hydraulic chamber and when the vane rotor receives the torque variation on the advance side, the working fluid in the retard hydraulic chamber receives force to flow out of the retard hydraulic chamber. Then, there is presented the following problem: for example, when the pressure of the working fluid supplied from a fluid supply source is low, in a case where the working fluid is supplied to the advance hydraulic chamber to change the phase of the camshaft from the retard side to the advance side with respect to the crankshaft, as shown by a dotted line in FIG. 23, the vane rotor is returned to the retard side by the torque variation to elongate a response time that elapses before a target phase is reached.

As described in JP 2003-106115A, it is thought that a check valve is disposed in a supply passage for supplying a working fluid to a retard hydraulic chamber and an advance hydraulic chamber to prevent the working fluid from flowing out of the retard hydraulic chamber or the advance hydraulic chamber even if a vane rotor receives torque variation. It is known in this manner that, as shown in FIG. 23, the vane rotor is prevented from returning to the opposite side of a target phase with respect to a housing during performing a phase control to enhance the responsivity of the phase control.

However, check valves are disposed in a retard supply passage and an advance supply passage that supply the working fluid to the retard hydraulic chamber and the advance hydraulic chamber, respectively, which in turn presents a problem of increasing the number of parts.

Meanwhile, torque variation that a camshaft receives from an intake valve or an exhaust valve when the intake valve or the exhaust valve is opened or closed is applied on the average in a direction that prevents the rotation of the camshaft, in other words, on the retard side (hereafter, direction of torque variation applying on the retard side is referred to as "positive" and direction of torque variation applying on the advance side is referred to as "negative"), so that even in a construction having a check valve not disposed in the retard supply passage, a valve timing can be controlled on the retard side within a comparatively short response time.

Hence, U.S. Pat. No. 5,657,725 discloses an apparatus having a check valve disposed only in an advance supply passage. Moreover, there is disclosed the following passage construction: in the case of performing the advance control of valve timing, even when torque variation is applied on the retard side, the check valve prohibits the working fluid from flowing out of the advance hydraulic chamber and when torque variation is applied on the advance side, the working fluid flowing out of the retard hydraulic chamber flows into the advance hydraulic chamber. In this manner, in the case of performing the advance control, the working fluid flowing out of the retard hydraulic chamber is supplied to the advance hydraulic chamber by the use of torque variation applied on the retard side to assist the advance control of valve timing.

However, according to the apparatus disclosed in U.S. Pat. No. 5,657,725 (FIG. 3A to FIG. 3C), a check valve is disposed only in the advance supply passage, it is only one retard hydraulic chamber and one advance hydraulic chamber that have the working fluid supplied from a fluid supply source. As a result, in the construction in which the advance control of valve timing is performed by the use of torque variation that the camshaft receives on the retard side, as shown in FIGS. 24A and 24B, when the cylinders increases in number to reduce torque variation applied to the camshaft on the retard side, in a case where the number of revolutions of the engine is small and where the pressure of the working fluid is low, there is a possibility that the responsivity of the phase control to the advance side will deteriorate or that the phase control to the advance side will not be performed. FIG. 24A is an example showing the torque variation of an in-line 4-cylinder engine and FIG. 24B is an example showing the torque variation of an in-line 6-cylinder engine.

SUMMARY OF THE INVENTION

The present invention has been made to solve the above problems. The object of the present invention is to provide a valve timing controller that has a high responsivity of a phase control to an advance side and is small in the number of parts.

According to the present invention, a check valve that allows a working fluid to flow from a fluid supply source to an advance hydraulic chamber and prohibits the working fluid from flowing back from the advance hydraulic chamber to the fluid supply source is disposed in the first advance passage. Hence, when an advance control is performed which turns and drives a driven rotary body rotating with a driven shaft to a target phase on a advance side relatively to a driving rotary body rotating with a driving shaft of a housing or a vane rotor, even if the driven rotary body receives torque variation on the retard side from the driven shaft, the check valve can prevent the working fluid from flowing out of the advance hydraulic chamber connected to the first advance passage in which the check valve is disposed. If the working fluid is prevented from flowing out of at least one advance hydraulic chamber, it is possible to prevent the working fluid from flowing out of all the advance hydraulic chambers. The driven rotary body is prevented from returning to the retard side from the target phase of the advance side during a phase control, so that the driven rotary body can quickly reach the target phase on the advance side with respect to the driving rotary body. Therefore, the responsivity of the phase control to the advance side can be improved. In the case where the target phase is on the retard side, the mean torque variation is applied to the retard side which is a positive side. Accordingly, even if a check valve is not disposed in a retard passage for supplying the working fluid to the retard hydraulic chamber, the driven rotary body can quickly reach the target phase of the retard side with respect to the driving rotary body.

Meanwhile, such working fluid in the advance hydraulic chamber that is prevented from flowing out to the fluid supply source by the check valve is discharged from the advance hydraulic chamber through the second advance passage. Moreover, the retard passage having no check valve can serve as the supply passage and the discharge passage of the working fluid.

In this manner, the check valve is disposed in the first advance passage and is not disposed in the retard passage. Hence, it is possible to reduce the number of parts and the number of fluid passages.

Further, a plurality of retard hydraulic chambers and a plurality of advance hydraulic chambers are formed and the working fluid is supplied to the respective retard hydraulic chambers and the respective advance hydraulic chambers from the fluid supply source. Therefore, the area of portions where the driven rotary receives the pressure of the working fluid in the advance hydraulic chambers and the retard hydraulic chambers increase. Accordingly, in an engine having many cylinders and hence has little torque variation, even if the number of revolutions of the engine is low and the pressure of the working fluid is low, the driven rotary body can be driven to the advance side to quickly reach the target phase.

DETAILED DESCRIPTION OF THE PREFERRED EMBODIMENTS

Hereafter, a plurality of preferred embodiments of the present invention will be described on the basis of the drawings.

First Embodiment

Figure 1:
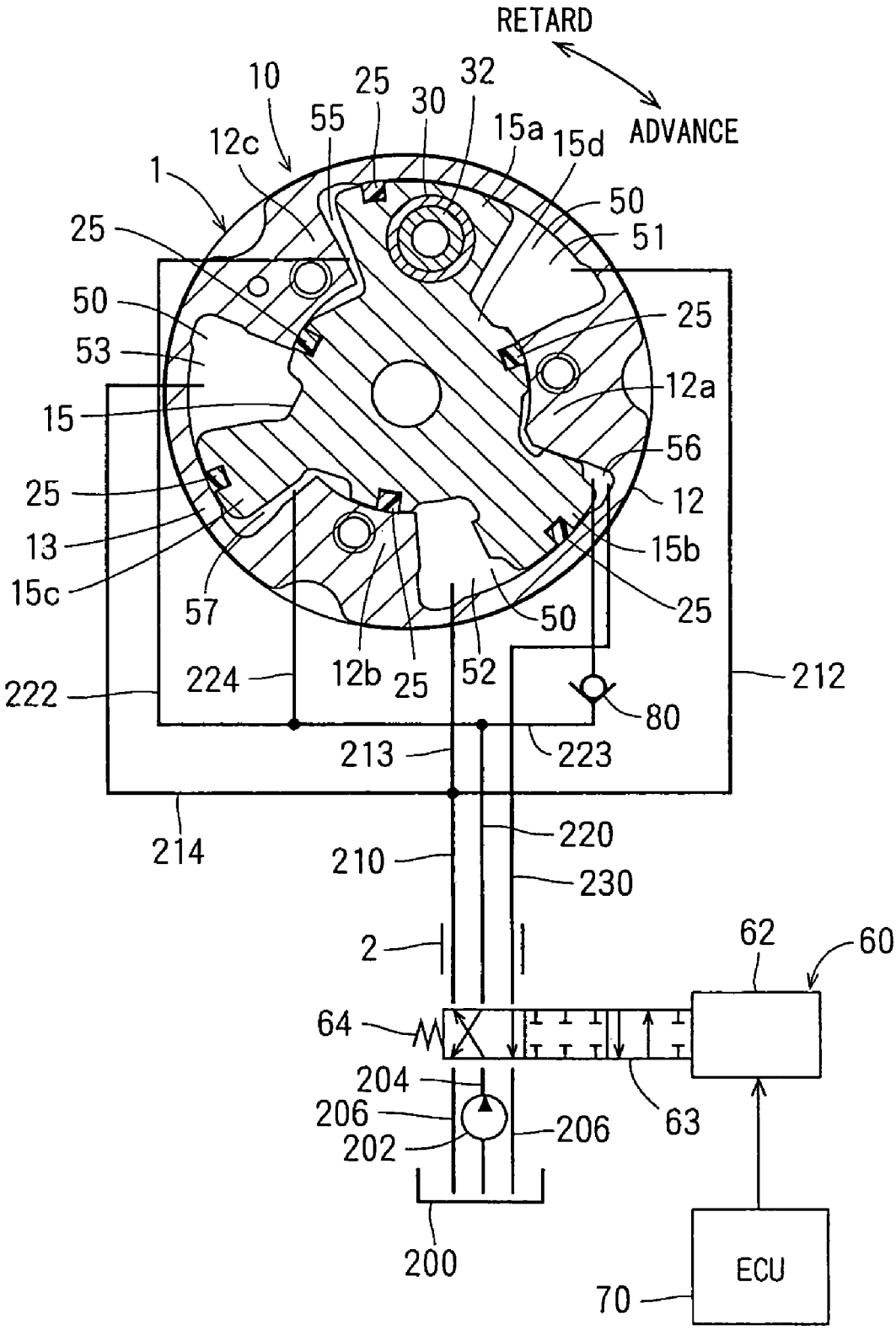
FIG. 1 is a sectional view taken on a line I—I in FIG. 2.
Figure 2:
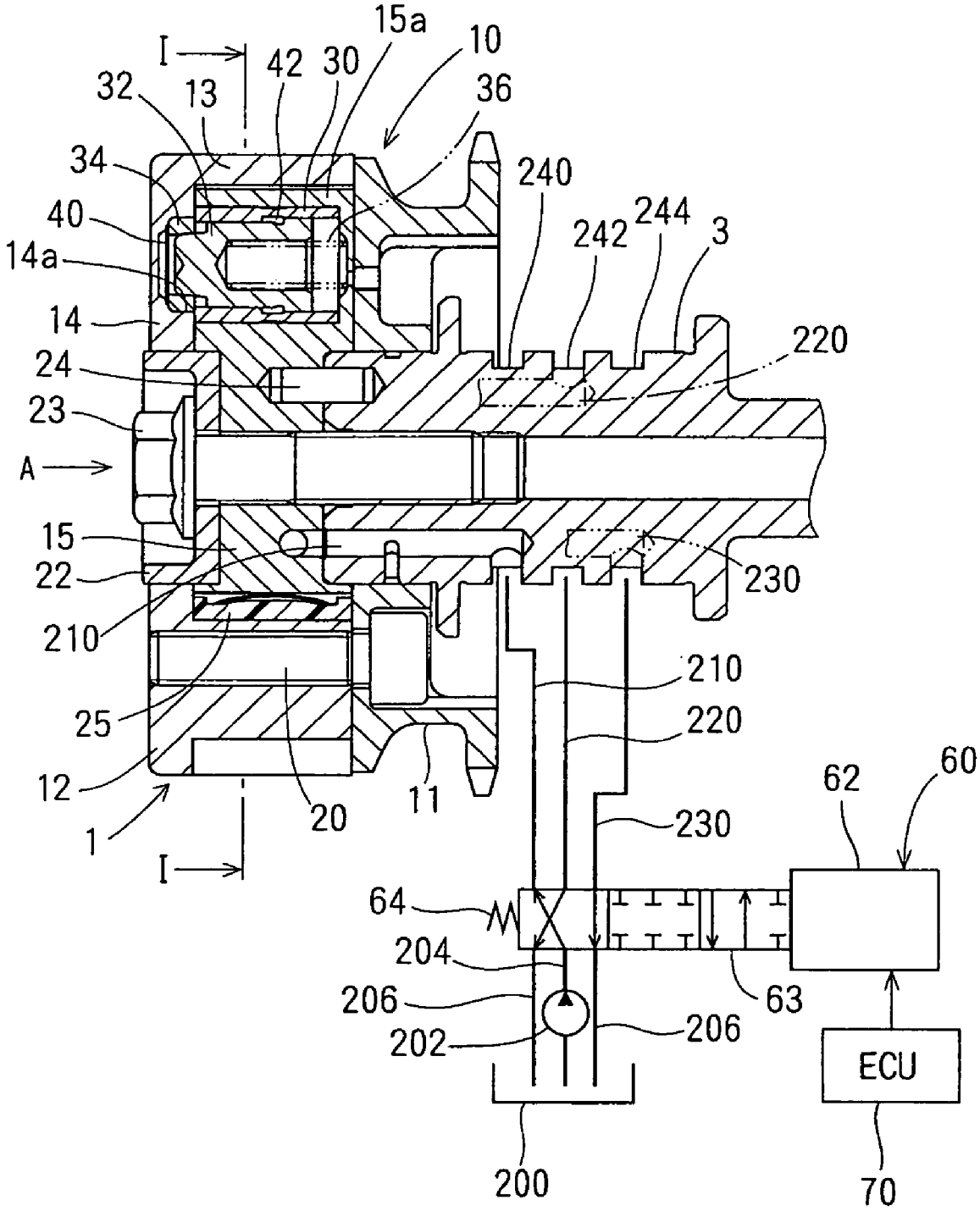
FIG. 2 is a longitudinal sectional view showing a valve timing controller in accordance with the first embodiment of the present invention.

A valve timing controller in accordance with the first embodiment of the present invention is shown in FIG. 1 and FIG. 2. A valve timing controller 1 in accordance with the first embodiment is a hydraulic control type apparatus using a working oil as a working fluid and adjusts the valve timing of an intake valve.

As shown in FIG. 2, a housing 10 of a driving rotary body 10 has a chain sprocket 11 and a shoe housing 12. The shoe housing 12 includes shoes 12*a*, 12*b*, and 12*c* (see FIG. 1) as a partitioning part, a ring-shaped peripheral wall 13, and a front plate 14 opposed to the chain sprocket 11 with the peripheral wall 13 sandwiched between them, and is integrally formed with them. The chain sprocket 11 and the shoe housing 12 are coaxially fixed to each other by bolts 20. The chain sprocket 11 is coupled to a crankshaft (not shown) as the driving shaft of an engine by a chain (not shown), thereby having a driving force transferred thereto and rotating in synchronization with the crankshaft.

A camshaft 3 as a driven shaft has the driving force of the crankshaft transferred thereto via the valve timing controller 1 to open/close an intake valve (not shown). The camshaft 3 is inserted into the chain sprocket 11 in such a way as to be able to turn at a predetermined phase difference with respect to the chain sprocket 11.

A vane rotor 15 as a driven rotary body abuts against the end face in the direction of rotary shaft of the camshaft and the camshaft 3, the vane rotor 15, and a bush 22 are coaxially fixed to each other by a bolt 23. The positioning of the vane rotor 15 and the camshaft 3 in a rotational direction is performed by fitting a positioning pin 24 in the vane rotor 15 and the camshaft 3. The camshaft 3, the housing 10, and the vane rotor 15 rotate clockwise when viewed from the direction shown by arrow A in FIG. 2. Hereafter, this rotational direction is assumed to be the advance direction of the camshaft 3 with respect to the crankshaft.

As shown in FIG. 1, the shoes 12*a*, 12*b*, and 12*c* each formed in a trapezoidal shape are extended inward in the radial direction from the peripheral wall 13 and are arranged at nearly equal intervals in the rotational direction of the peripheral wall 13. Three fan-shaped receiving chambers 50 that receive the vanes 15*a*, 15*b*, and 15*c*, respectively, are formed in three spaces each formed in a predetermined angular range in the rotational direction by the shoes 12*a*, 12*b*, and 12*c*, respectively.

The vane rotor 15 has a boss 15*d* coupled to the camshaft 3 at the end face in the axial direction and the vanes 15*a*, 15*b*, and 15*c* arranged at nearly equal intervals in the rotational direction on the outer peripheral side of the boss 15*d*. The vane rotor 15 is received in the housing 10 in such a way as to be able to turn relatively to the housing 10. The vanes 15*a*, 15*b*, and 15*c* are respectively received in the receiving chambers 50 in such a way as to be able to turn. Each vane partitions each receiving chamber 50 into two chambers of a retard hydraulic chamber and an advance hydraulic chamber. Arrows showing a retard direction and an advance direction in FIG. 1 designate a retard direction and an advance direction of the vane rotor 15 with respect to the housing 10.

Sealing members 25 are arranged in sliding spaces formed between the respective shoes and the boss 15*d*, which are opposed each other in the radial direction, and between the respective shoes and the inner peripheral wall of the peripheral wall 13. The sealing members 25 are fitted in the grooves, which are formed in the boss 15*d* and in the outer peripheral walls of the respective vanes, and are biased toward the respective vanes and the inner peripheral wall of the peripheral wall 13. With this construction, the sealing members 25 prevent the working fluid from leaking between the respective retard hydraulic chambers and the respective advance hydraulic chambers, respectively.

As shown in FIG. 2, a cylindrical guide ring 30 is pressed into the vane 15*a*. A cylindrically formed stopper piston 32 is received in the guide ring 30 in such a way as to be able to slide in the direction of the rotary shaft. A fitting ring 34 is pressed into and held by a recessed portion 14*a* formed in the front plate 14. The stopper piston 32 can be fitted in the fitting ring 34. The stopper piston 32 and the fitting ring 34 are tapered on their fitting sides and hence the stopper piston 32 can be smoothly fitted in the fitting ring 34. A spring 36 as biasing means biases the stopper piston 32 to the fitting ring 34. The stopper piston 32, the fitting ring 34, and the spring 36 construct constraining means for constraining the relative turn of the vane rotor 15 to the housing 10.

The pressure of the working fluid supplied to a hydraulic chamber 40 formed on the front plate 14 side of the stopper piston 32 and a hydraulic chamber 42 formed in the outer periphery of the stopper piston 32 works in the direction in which the stopper piston 32 comes out of the fitting ring 34. The hydraulic chamber 40 connects with any one of the advance hydraulic chambers, which will be described later, and the hydraulic chamber 42 connects with any one of the retard hydraulic chambers. The tip of the stopper piston 32 can be fitted in the fitting ring 34 when the vane rotor 15 is positioned at the maximum retard position with respect to the housing 10. The relative turn of the vane rotor 15 to the housing 10 is constrained in a state where the stopper piston 32 is fitted in the fitting ring 34.

When the vane rotor 15 is turned from the maximum retard position to an advance side with respect to the housing 10, the stopper piston 32 is shifted in the position in the rotational direction from the fitting ring 34, whereby the stopper piston 32 cannot be fitted in the fitting ring 34.

As shown in FIG. 1, a retard hydraulic chamber 51 is formed between the shoe 12*a* and the vane 15*a*, a retard hydraulic chamber 52 is formed between the shoe 12*b* and the vane 15*b*, and a retard hydraulic chamber 53 is formed between the shoe 12*c* and the vane 15*c*. Moreover, an advancing chamber 55 is formed between the shoe 12*c* and the vane 15*a*, an advance hydraulic chamber 56 is formed between the shoe 12*a* and the vane 15*b*, and an advance hydraulic chamber 57 is formed between the shoe 12*b* and the vane 15*c*.

An oil pump 202 as a fluid supply source supplies a working oil sucked from a drain 200 to a supply passage 204. A switching valve 60 is a well-known electromagnetic spool valve and is interposed between (a supply passage 204 and a discharge passage 206) and (a retard passage 210, an advance passage 220, and an advance passage 230) on the oil pump 202 side of a bearing 2. The switching valve 60 is switched and controlled by a driving current which is supplied from an electronic control unit (ECU) to an electromagnetic driving part 62 and whose duty ratio is controlled. The spool 63 of the switching valve 60 is displaced on the basis of the duty ratio of the driving current. The switching valve 60 switches the supplying of the working oil to the respective retard hydraulic chambers and the respective advance hydraulic chambers and the discharging of the working oil from the respective retard hydraulic chambers and the respective advance hydraulic chambers by the position of this spool 63. The spool 63 is located at the position shown in FIG. 1 by the biasing force of the spring 64.

As shown in FIG. 2, annular passages 240, 242, and 244 are formed in the outer peripheral wall of the camshaft 3 journaled by the bearing 2. The retard passage 210 is formed in such a way as to pass from the switching valve 60 through the annular passage 240, the camshaft 3, and the boss 15*d* of the vane rotor 15. The advance passage 220 is formed in such a way as to pass from the switching valve 60 through the annular passage 242, the camshaft 3, and the boss 15*d* of the vane rotor 15. The advance passage 230 is formed in such a way as to pass from the switching valve 60 through the annular passage 244, the camshaft 3, and the boss 15*d* of the vane rotor 15.

As shown in FIG. 1, the retard passage 210 is branched to retard passages 212, 213, and 214 connected to the retard hydraulic chambers 51, 52, and 53. The retard passages 210, 212, 213, and 214 supply the working oil to the respective retard hydraulic chambers and discharge the working oil to a drain 200, which is a fluid discharge side, from the respective retard hydraulic chambers. Therefore, the retard passages 210, 212, 213, and 214 serve as retard supply passages and retard discharge passages.

The advance passage 220 is branched to advance passages 222, 223, and 224 connected to advance hydraulic chambers 55, 56, and 57. The advance passages 220, 222, 223, and 224 as the first advance passages are advance supply passages for supplying the working oil to the respective advance hydraulic chambers. Further, the advance passages 220, 222, and 224 discharge the working oil from the advance hydraulic chambers 55, 57. Therefore, the advance passages 220, 222, and 224 serve as the advance supply passages and the advance discharge passages. The working oil in the advance hydraulic chamber 56 is discharged from the advance passage 230 as the second advance passage to the drain 200.

A check valve 80 is disposed closer to the advance hydraulic chamber 56 of the advance passage 223 than the bearing 2. The check valve 80 allows the working oil to flow from the oil pump 202 through the advance passage 223 to the advance hydraulic chamber 56 and prohibits the working oil from flowing backward from the advance hydraulic chamber 56 through the advance passage 223 to the oil pump 202.

With the passage construction described above, the working oil can be supplied from the oil pump 202 to the retard hydraulic chambers 51, 52, and 53, the advance hydraulic chambers 55, 56, and 57, and the hydraulic chambers 40, 42 and can be discharged from the respective hydraulic chambers to the drain 200.

Next, the operation of the valve timing controller 1 will be described.

In a state where the engine is stopped, the stopper pin 32 is fitted in the fitting ring 34. In a state just after the starting of the engine, the working oil is not sufficiently supplied from the oil pump 202 to the retard hydraulic chambers 51, 52, and 53, the advance hydraulic chambers 55, 56, and 57, and the hydraulic chambers 40, 42 and hence the stopper pin 32 is held fitted in the fitting ring 34 and the camshaft is held at the maximum retard position with respect to the crankshaft. With this, until the working oil is supplied to the respective hydraulic chambers, the housing 10 and the vane rotor 15 are prevented from being oscillated and vibrated by torque variation applied to the camshaft, thereby being prevented from colliding with each other to cause impact noises.

When the working oil is sufficiently supplied from the oil pump 202 after the engine is started, the stopper pin 32 is removed from the fitting ring 34 by the hydraulic pressure of the working oil supplied to the hydraulic chamber 40 or the hydraulic chamber 42 and hence the vane rotor 15 can be freely turned relatively to the housing 10. By controlling the hydraulic pressure applied to the respective retard hydraulic chambers and the respective advance hydraulic chambers, the phase difference of the camshaft to the crankshaft is adjusted.

In a state shown in FIG. 1 where the passing of current to the switching valve 60 is stopped, the spool 63 is located at the position shown in FIG. 1 by the biasing force of the spring 64. In this state, the working oil is supplied from the supply passage 204 to the retard passage 210 and is supplied through the retard passages 212, 213, and 214 to the respective retard hydraulic chambers. In this state, the working oil in the advance hydraulic chambers 55, 57 is discharged from the advance passages 222, 224 through the advance passage 220, the switching valve 60, and the discharge passage 206 to the drain 200. The working oil in the advance hydraulic chamber 56 is discharged through the advance passages 230, the switching valve 60, the discharge passage 206 to the drain 200 because the check valve 80 is disposed in the advance passage 223. In this manner, the working oil is supplied to the respective retard hydraulic chambers and is discharged from the respective advance hydraulic chambers, so that the vane rotor 15 receives hydraulic pressure from three retard hydraulic chambers 51, 52, and 53, thereby being rotated with respect to the housing 10.

As shown in FIG. 1, when the working oil is supplied to the respective retard hydraulic chambers and is discharged from the advance hydraulic chambers to control phase to the target phase of the retard side, if the camshaft receives torque variation, the vane rotor 15 receives torque variation on the retard side and the advance side with respect to the housing 10. However, because the torque variation that the vane rotor 15 receives is applied on the average on the retard side, when the working oil is supplied to the respective retard hydraulic chambers and is discharged from the respective advance hydraulic chambers to control the phase to the retard side, even in a construction in which a check valve for prohibiting the working oil from flowing out of the retard hydraulic chamber is not provided in any one of retard passages 210, 212, 213, and 214, the vane rotor quickly reaches the target phase of the retard side.

Figure 3:
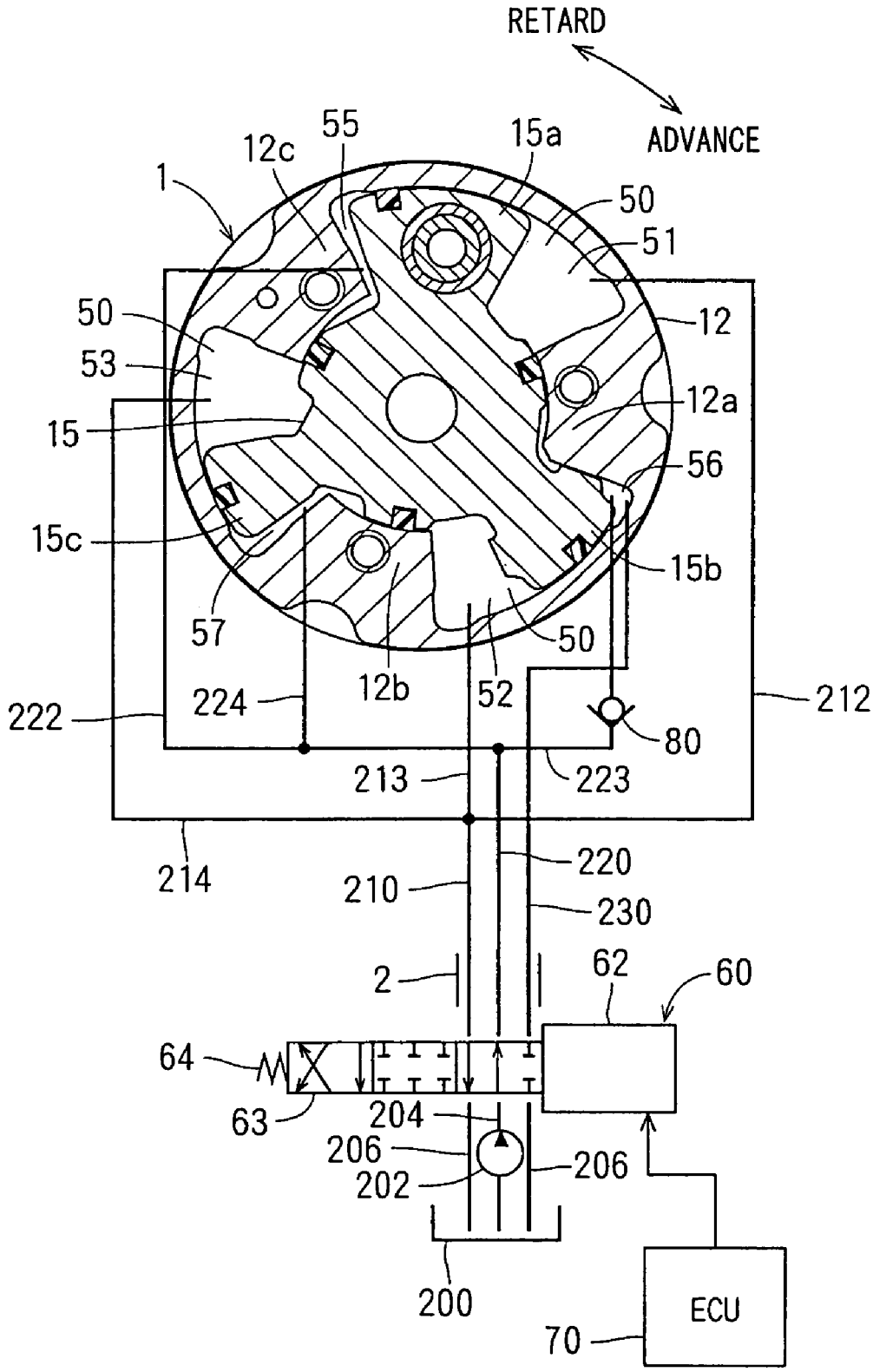
FIG. 3 is a sectional view showing the state of a valve timing controller at the time of performing an advance control.

Next, when the passing of current through the check valve 60 is started, as shown in FIG. 3, the electromagnetic force of the electromagnetic driving part 62 is applied to the spool 63 against the biasing force of the spring 74 to locate the spool 63 at the position shown in FIG. 3. In this state, the working oil is supplied from the supply passage 204 to the advance passage 220 and is passed through the advance passages 222, 223, and 224 to the respective advance hydraulic chambers. In the case of the advance passage 223, the working oil is supplied through the check valve 80 to the advance hydraulic chamber 56. The working oil in the retard hydraulic chambers 51, 52, and 53 is discharged from the retard passages 212, 213, and 214 through the retard passage 210, the switching valve 60, and the discharge passage 206 to the drain 200. When the working oil is supplied to the respective advance hydraulic chambers and is discharged from the respective retard hydraulic chambers in this manner, the vane rotor 15 receives the hydraulic pressure from three advance hydraulic chambers 55, 56, and 57 and rotates to the advance side with respect to the housing 10.

Figure 23:
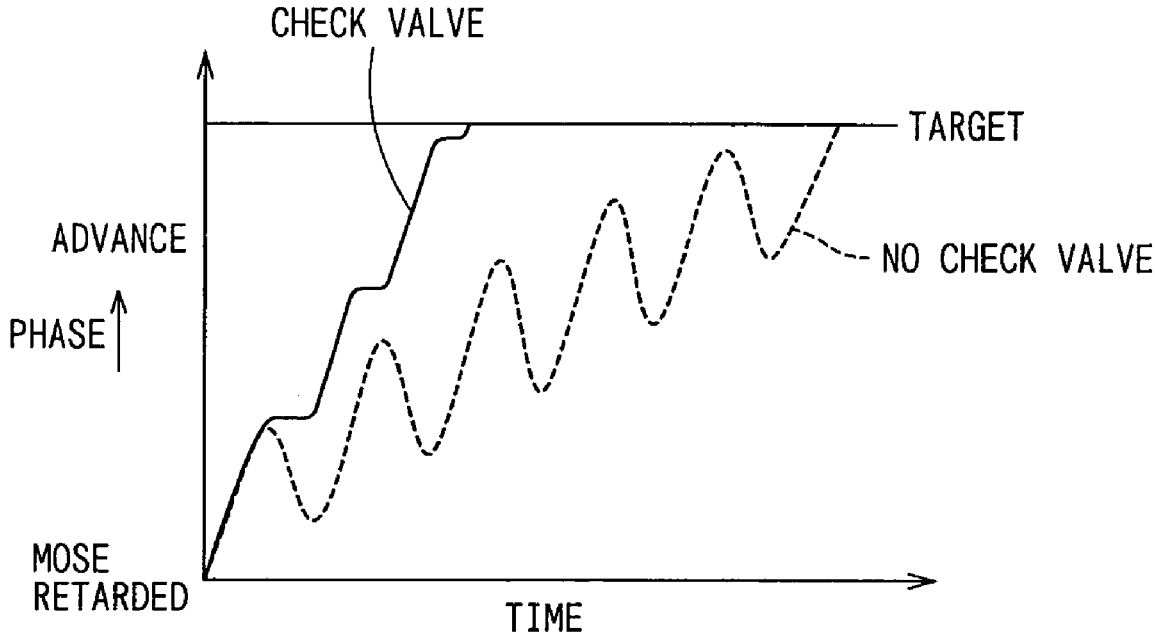
FIG. 23 PRIOR ART
FIG. 23 is a characteristic diagram showing a difference in time that elapses before the target phase is reached between the presence and the absence of a check valve.
Figure 24A:
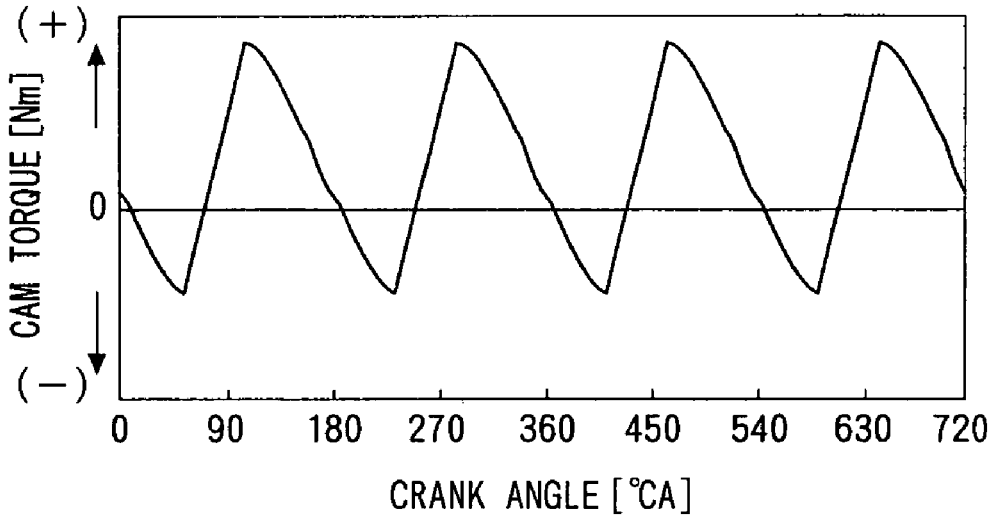
FIG. 24A PRIOR ART
FIG. 24A is a characteristic diagram showing the relationship between a crank angle and a cam torque in an in-line 4-cylinder engine.
Figure 24B:
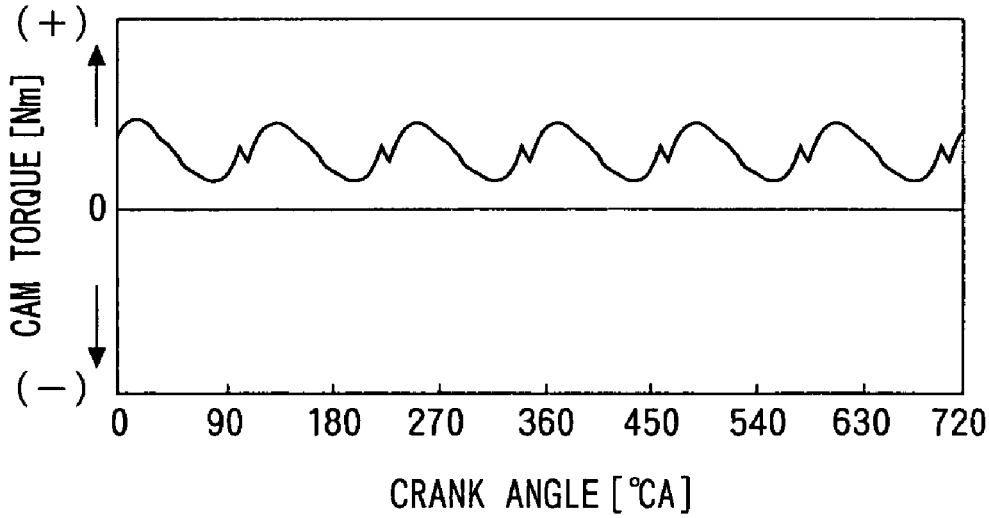
FIG. 24B PRIOR ART
FIG. 24B is a characteristic diagram showing the relationship between a crank angle and a cam torque in an in-line 6-cylinder engine.

As shown in FIG. 3, when the working oil is supplied to the respective advance hydraulic chambers and is discharged from the respective retard hydraulic chambers to control the phase to the target phase of the advance side, like the retard control, the vane rotor 15 receives torque variation on the retard side and on the advance side with respect to the housing 10. When the vane rotor 15 receives the torque variation on the retard side, the working oil in the respective advance hydraulic chambers receives a force to flow to the advance passages 222, 223, and 224. However, because the check valve 80 is disposed in the advance passage 223, the working oil does not flow out of the advance hydraulic chamber 56 to the advance passage 223. Hence, when the hydraulic pressure of the oil pump 202 is low, even if the vane rotor 15 receives the torque variation on the retard side, the vane rotor 15 is not returned to the retard side with respect to the housing 10. As a result, the working oil does not flow out of the advance hydraulic chambers 55, 57, either. Therefore, even if the vane rotor 15 receives torque variation on the retard side from the camshaft, it is possible to prevent the vane rotor 15 from being returned to the retard side opposite to the target phase, as shown in FIG. 23, so that the vane rotor 15 quickly reaches the target phase of the advance side.

When the vane rotor 15 reaches the target phase, the ECU 70 controls the duty ratio of the driving current to be supplied to the switching valve 60 to hold the spool 63 at a middle position between FIG. 1 and FIG. 3. As a result, the switching valve 60 interrupts the connections of the retard passage 210, the advance passage 220, and the advance passage 230 to the oil pump 202 and the drain 200 to prevent the working oil from discharging from the respective retard hydraulic chambers and the respective advance hydraulic chambers to the drain 200, so that the vane rotor 15 is held at the target phase.

In the first embodiment, the check valve 80 is disposed only in the advance passage 223 for supplying the working oil to the advance hydraulic chamber 56. Hence, the operation that the vane rotor 15 receives torque variation, at the time of controlling the phase to the advance side when the hydraulic pressure of the oil pump 202 is low, to flow out the working oil from the respective advance hydraulic chambers is prevented by a small number of parts.

Second Embodiment

Figure 4:
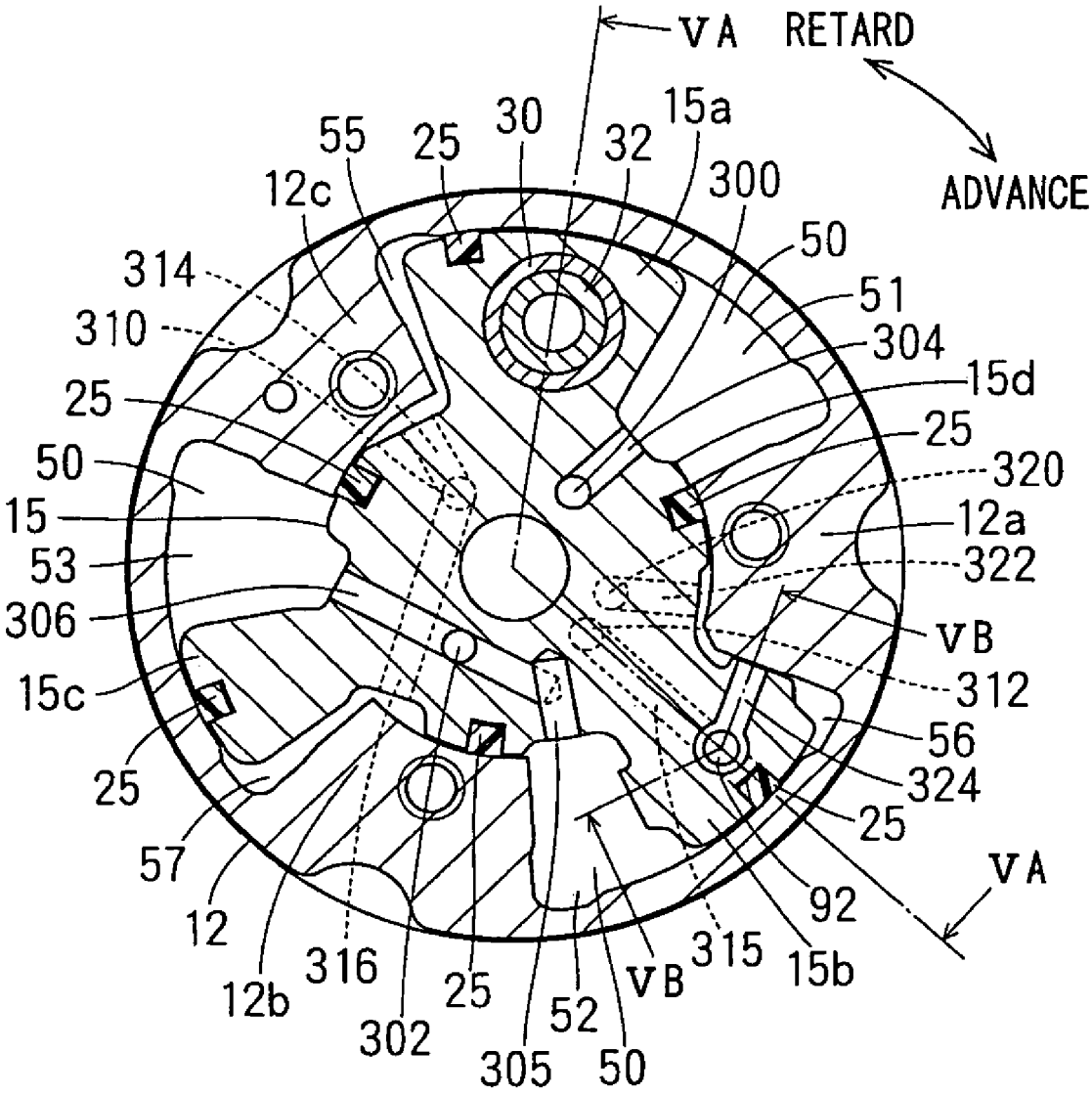
FIG. 4 is a sectional view showing a valve timing controller in accordance with the second embodiment of the present invention in the same sectional position as in FIG. 1.
Figure 5A:
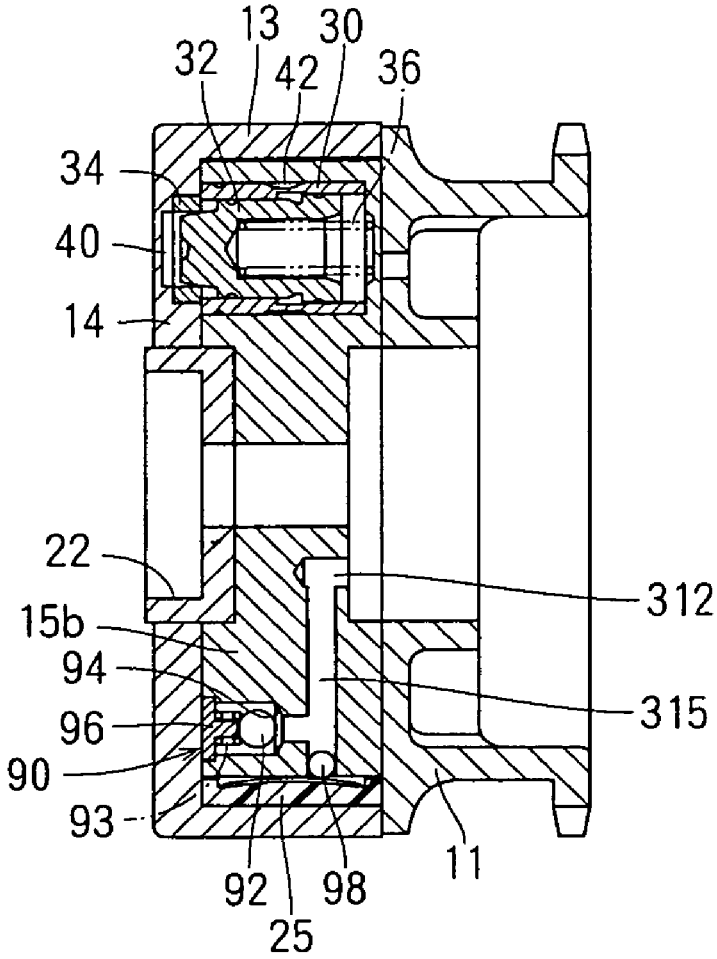
FIG. 5A is a sectional view taken on a line VA—VA in FIG. 4
Figure 5B:
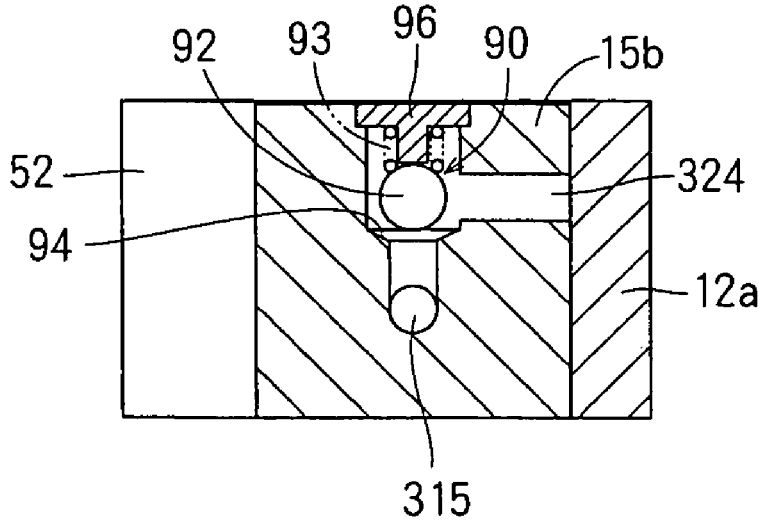
FIG. 5B is a sectional view taken on a line VB—VB in FIG. 4.

The second embodiment of the present invention is shown in FIG. 4 and FIGS. 5A and 5B. Here, the substantially same constituent parts as in the first embodiment are denoted by the same reference symbols.

As shown in FIG. 4, retard passages 300, 302 are formed in the direction of a rotary shaft in the boss 15*d* of the vane rotor 15. A retard passage 304 connects the retard passage 300 to the retard hydraulic chamber 51, and a retard passage 305 connects the retard passage 302 to the retard hydraulic chamber 52, and a retard passage 306 connects the retard passage 302 to the retard hydraulic chamber 53. The retard passages 300, 302, 304, 305, and 306 serve as the retard supply passage and the retard discharge passage, respectively.

Further, advance passages 310, 312 are formed in the direction of the rotary shaft in the boss 15*d* of the vane rotor 15. An advance passage 314 connects the advance passage 310 to the advance hydraulic chamber 55, and an advance passage 315 connects the advance passage 312 to the advance hydraulic chamber 56 via a check valve 90 (see FIGS. 5A and 5B) and an advance passage 324, and an advance passage 316 connects the advance passage 310 to the advance hydraulic chamber 57. Further, an advance passage 320 is formed in the direction of the rotary shaft in the boss 15*d* of the vane rotor 15. An advance passage 322 connects the advance passages 320 to the advance hydraulic chamber 56. The advance passages 310, 312, 314, 315, 316, and 324 as the first advance passages are advance supply passages for supplying the working oil to the respective advancing chambers, and the advance passages 320, 322 as the second advance passages are advance discharge passages for discharging the working oil from the advancing chamber 56. The advance passages 310, 314, and 316 serve as the advance supply passage and the advance discharge passage.

The check valve 90, as shown in FIG. 4 and FIGS. 5A and 5B, is disposed in the advance passages 315, 324 in the vane 15*b* of the vane rotor 15. The check valve 90 has a ball 92, a spring 93, a valve seat 94 provided in the vane 15*b*, and a sealing tap 96. When the ball 92 is seated on the valve seat 94, the working oil is prohibited from flowing out of the advance hydraulic chamber 56 to the advance passages 315, 312. The sealing tap 96 seals an opening, which is formed to insert the ball 92 into the vane 15*b*, and serves as the stopper of the ball 92 and a spring seat for retaining one end of the spring 93. Further, a ball 98 seals an opening formed when the advance passage 315 is formed from the outside in the radial direction of the vane 15*b*.

In the second embodiment, the ball 92 is displaced in the direction of rotary shaft of the vane rotor 15 to interrupt the connection between the advance passage 324 and the advance passage 315 and hence the centrifugal force produced by the rotation of the vane rotor 15 is not applied in the direction in which the ball 92 is moved. Hence, the check valve 90 operates with almost no suffering of the effect of the centrifugal force.

Further, because the check valve 90 is disposed in the vane 15*b* of the vane rotor 15, the length of a passage between the advance hydraulic chamber 56 and the check valve 90 is made short. With this, the dead volume formed by the advance passage 324 between the advance hydraulic chamber 56 and the check valve 90 is made small. Hence, even if the vane rotor 15 receives torque variation at the time of performing the phase control, a pressure drop in the advance hydraulic chamber 56 to which the working oil is supplied can be prevented. Therefore, the responsivity of the phase control to the advance side can be improved.

Here, when the number of revolutions of the engine is increased to increase hydraulic pressure, the working oil can be supplied to the advance hydraulic chamber 56 against the torque variation on the retard side. Further, when the check valve 90 is opened, the pressure loss of the advance supply passage to supply the working oil to the advance hydraulic chamber 56 through the check valve 90 becomes lower. Hence, when the number of revolutions of the engine is increased to increase the hydraulic pressure, even if the vane rotor 15 receives torque variation, it is preferable that the check valve 90 is open.

When the working oil is supplied to the advance hydraulic chamber 56, if the natural vibration frequency of the ball 92 of the check valve 90 is lower than the frequency of torque variation, the check valve 90 cannot be opened or closed in response to the torque variation but is held opened. The natural vibration frequency of the ball 92 of the check valve 90 is determined by the mass of the ball 92 and the spring constant of the spring 93. Because the number of revolutions of torque variation is increased when the number of revolutions of the engine is increased, it is preferable that the mass of the ball 92 and the spring constant of the spring 93 are selected so that, for example, when the number of revolutions of the engine is increased to 1500 to 3000 rpm to increase the hydraulic pressure, the check valve 90 is held opened.

Third Embodiment

Figure 6:
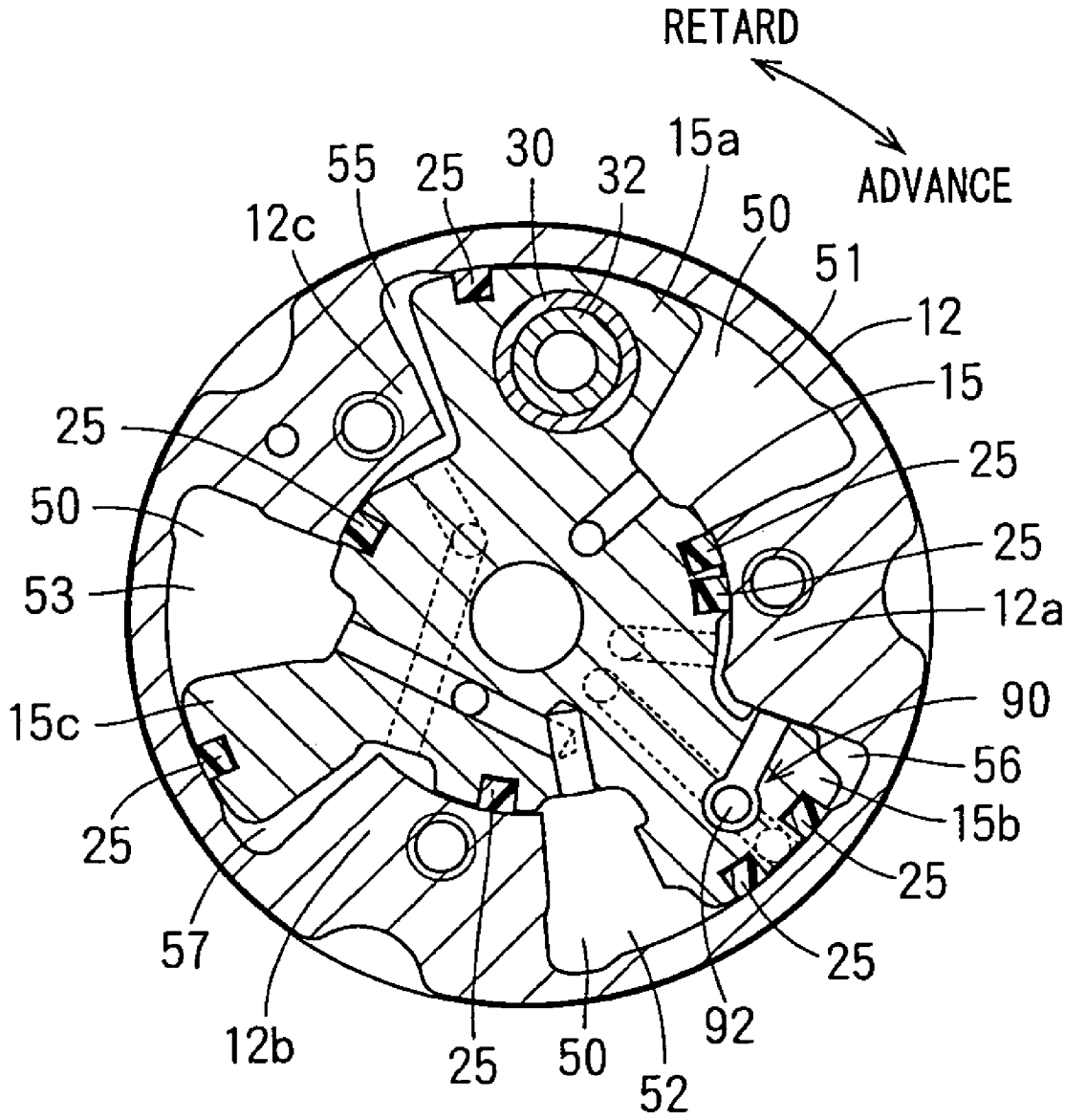
FIG. 6 is a sectional view showing a valve timing controller in accordance with the third embodiment of the present invention in the same sectional position as in FIG. 1.

The third embodiment of the present invention is shown in FIG. 6. In the third embodiment, sealing members 25 that seal gaps between the advance hydraulic chamber 56 and the retard hydraulic chambers 51, 52 are duplicated. The other construction is the substantially same as in the second embodiment.

When the vane rotor 15 receives torque variation on the retard side at the time of performing the phase control to the advance side, the check valve 90 prohibits the working oil from flowing out of the advance hydraulic chamber 56, so that the hydraulic pressure in the advance hydraulic chamber 56 becomes higher than the hydraulic pressure in the retard hydraulic chambers 55, 57. Hence, in the third embodiment, by duplicating the sealing members 25 that seal gaps between the advance hydraulic chamber 56 and the retard hydraulic chambers 51, 52, even if the hydraulic pressure in the advance hydraulic chamber 56 is increased, the working oil is prevented from leaking from the advance hydraulic chamber 56.

Fourth Embodiment

Figure 7:
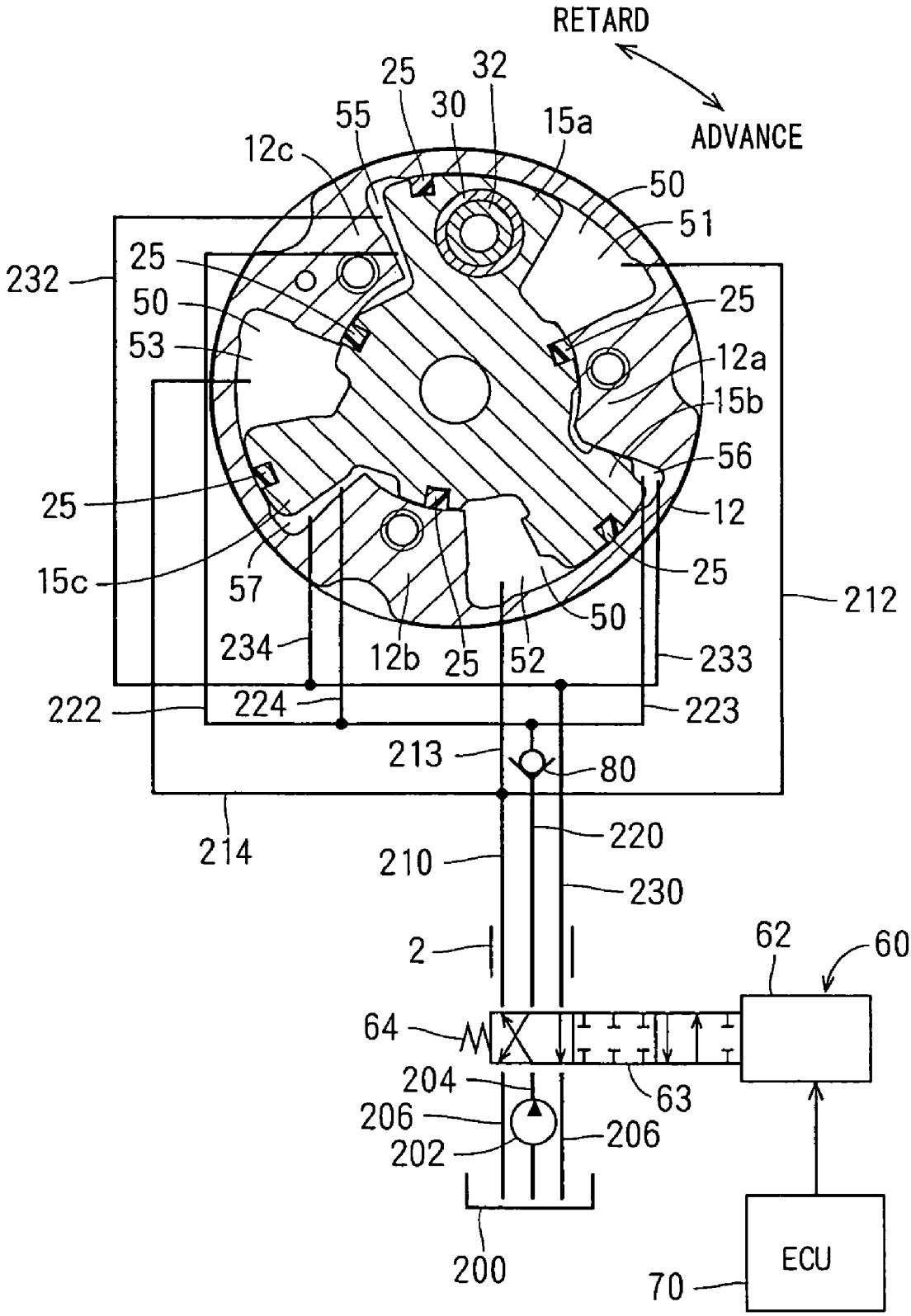
FIG. 7 is a sectional view showing a valve timing controller in accordance with the fourth embodiment of the present invention in the same sectional position as in FIG. 1.

The fourth embodiment of the present invention is shown in FIG. 7. The substantially same constituent parts as in the first embodiment are denoted by the same reference symbols.

The check valve 80 is disposed in the advance passage 220 where the advance passages 222, 223, and 224 meet on the oil pump 202 side. Hence, if the vane rotor 15 receives torque variation on the retard side when the working oil is supplied to the respective advance hydraulic chambers to advance valve timing, the check valve 80 prevents the working oil from flowing out of the respective advance hydraulic chambers. Therefore, in the fourth embodiment, the advance passages 220, 222, 223, and 224 as the first advance passage are exclusive to the advance supply passage for supplying the working oil to the respective hydraulic chambers.

The working oil cannot be discharged from the advance passages 220, 222, 223, and 224 to the drain 200 on the oil pump 202 side and hence the advance passages 232, 233, and 234 for discharging the working oil from the respective advance hydraulic chambers connect the advance passage 230 to the respective advance hydraulic chambers. The advance passages 230, 232, 233, and 234 as the second advance passages are exclusive to the advance discharge passage.

Fifth Embodiment

Figure 8:
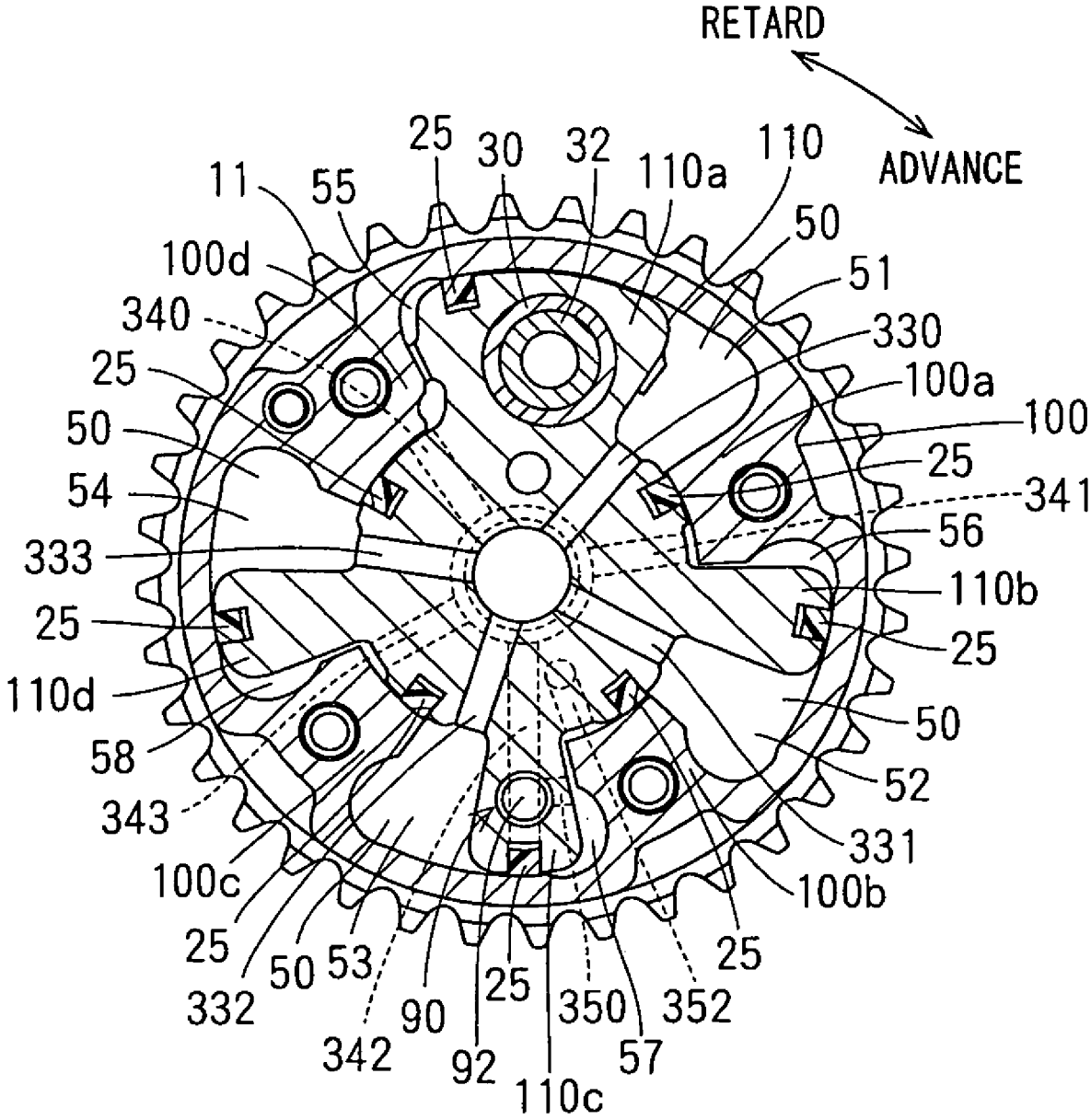
FIG. 8 is a sectional view showing a valve timing controller in accordance with the fifth embodiment of the present invention in the same sectional position as in FIG. 1.

The fifth embodiment of the present invention is shown in FIG. 8. The substantially same constituent parts as in the first embodiment are denoted by the same reference symbols.

In the fifth embodiment, the vane rotor 110 has four vanes 110*a*, 110*b*, 110*c*, and 110*d*. The respective vanes received in the receiving chambers 50 formed in the direction of rotation by the shoes 100*a*, 100*b*, 100*c*, and 100*d* of the shoe housing 100 partition the receiving chambers 50 into the retard hydraulic chamber 51 and the advance hydraulic chamber 55, the retard hydraulic chamber 52 and the advance hydraulic chamber 56, the retard hydraulic chamber 53 and the advance hydraulic chamber 57, and the retard hydraulic chamber 54 and the advance hydraulic chamber 58. The working oil is supplied from the retard passages 330, 331, 332, and 333 to the retard hydraulic chambers 51, 52, 53, and 54. The working oil is supplied from the advance passages 340, 341, and 343 to the advance hydraulic chambers 55, 56, and 58. The working oil is supplied from the advance passages 342, 350 to the advance hydraulic chamber 57. The working oil in the advance hydraulic chamber 57 is discharged from the advance passage 352.

The retard passages 330, 331, 332, and 333 serve as the retard supply passage and the retard discharge passage, respectively. Further, the advance passages 340, 341, 342, 343, and 350 of the first advance passages are advance supply passages for supplying the working oil to the respective advance hydraulic chambers. The advance passage 352 of the second advance passage is the advance discharge passages for discharging the working oil from the advance hydraulic chamber 57. The advance passages 340, 341, and 343 serve as the advance supply passage and the advance discharge passage, respectively.

The check valve 90 is disposed in the advance passages 342, 350 in the vane 110*c* and prohibits the working oil in the advance hydraulic chamber 57 from flowing out to the advance passage 342.

In the fifth embodiment, the vane rotor 110 has four vanes 110*a*, 110*b*, 110*c*, and 110*d* and hence the force that the vane rotor 110 receives from the working oil in the respective retard hydraulic chambers and the respective advance hydraulic chambers on the retard side and the advance side is made large. Therefore, this can reduce the size of a valve timing controller, which is advantageous for mounting the valve timing controller in the engine.

Sixth Embodiment

Figure 9:
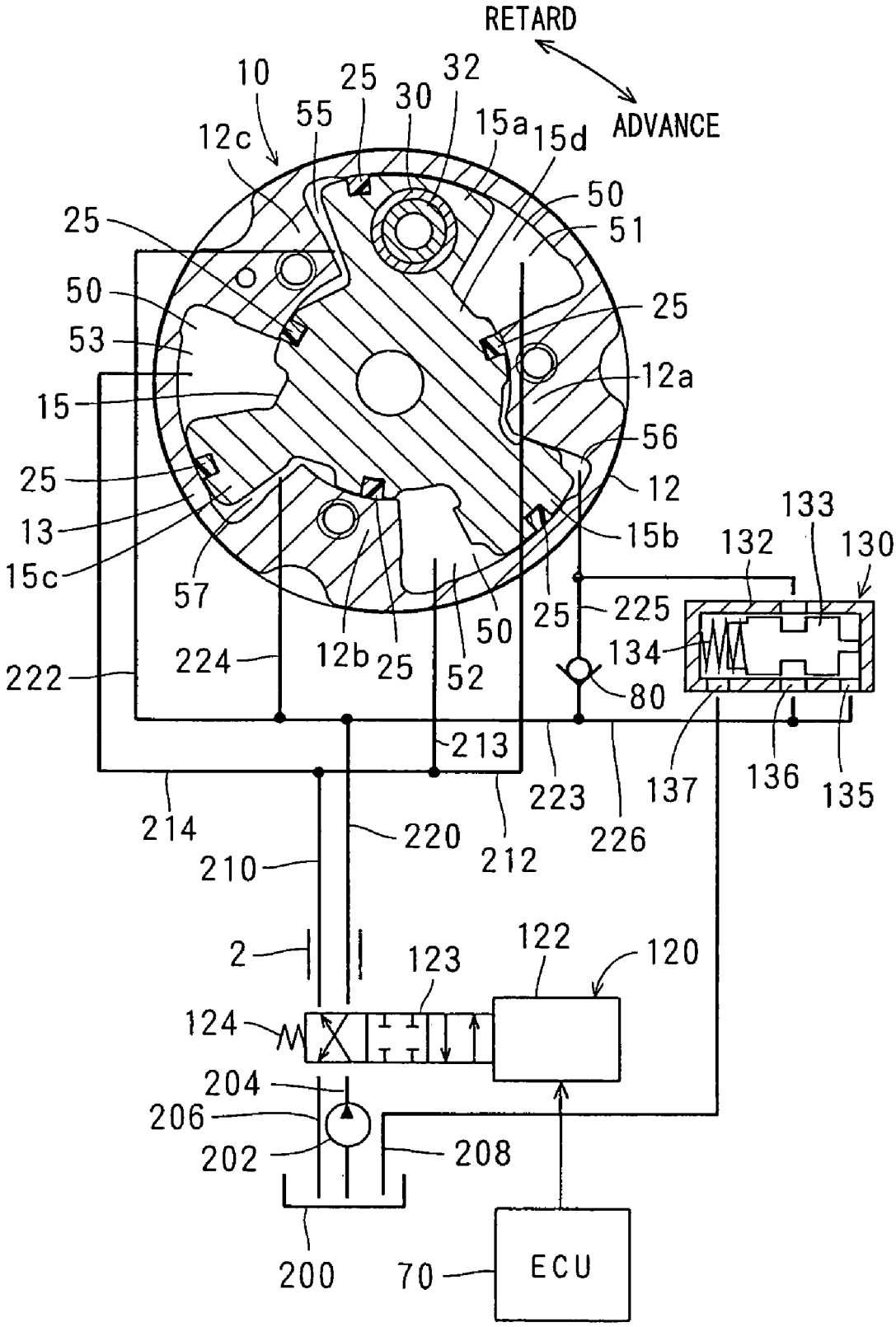
FIG. 9 is a sectional view taken on a line IX—IX in FIG. 10.

The sixth embodiment of the present invention is shown in FIG. 9. The substantially same constituent parts as in the first embodiment are denoted by the same reference symbols.

A switching valve 120 is a well-known electromagnetic spool valve and is interposed between (the supply passage 204 and a discharge passage 206) and (the retard passage 210 and the advance passage 220). The switching valve 120 is switched and controlled by a driving current which is supplied from the ECU 70 to an electromagnetic driving part 122 and whose duty ratio is controlled. The spool 123 of the switching valve 120 is displaced on the basis of the duty ratio of the driving current. According to the position of the spool 123, the switching valve 120 switches the supplying of the working oil to the respective retard hydraulic chambers and the respective advance hydraulic chambers and the discharging of the working oil from the respective retard hydraulic chambers and the respective advance hydraulic chambers. In the state where the passage of current through the switching valve 120 is stopped, the spool 123 is located at the position shown in FIG. 9 by the biasing force of the spring 124.

The advance passage 223 serves as the first advance passage and the second advance passage and is branched to the advance passage 225 having the check valve 80 disposed therein and the advance passage 226 having a control valve 130 disposed therein. The advance passage 226 as the second advance passage bypasses the check valve 80 and connects with the advance hydraulic chamber 56 side of the advance passage as the first advance passage 225 and with the oil pump 202.

A control valve 130 is a spool valve, which receives a spool 133 in a housing 132 such that the spool 133 freely reciprocates, and is disposed closer to the advance hydraulic chamber 56 than the bearing 2. A spring 134 biases the spool 133 in one direction of reciprocating directions. In the housing 132 are formed an advancing pressure port 135, a discharging port 136, and an open port 137. The advancing pressure port 135 has hydraulic pressure applied thereto not from the check valve 80 of the advance passage 225 but from the oil pump 202 via the advance passage 226. The discharge port 136 connects with the advance passage 226. The open port 137 connects with the discharge passage 208 and is open to the drain 200.

In a retard control state shown in FIG. 9 in which the passage of current through the switching valve 120 is stopped, the spool 123 is located at the position shown in FIG. 9 by the biasing force of the spring 124. In this state, the working oil is supplied from the supply passage 204 to the retard passage 210 and is supplied from the retard passages 212, 213, and 214 to the respective retard hydraulic chambers. The working oil in the advance hydraulic chambers 55, 57 is discharged from the advance passages 222, 224 through the advance passage 220, the switching valve 120, and the discharge passage 206 to the drain 200. The advance passage 223, the advance passage 225 on the oil pump 202 side of the check valve 80, and the advance passage 226 on the oil pump 202 side of the control valve 130 are open to the atmosphere.

The advance pressure port 135 of the control valve 130 connecting with the advance passage 226 is open to the atmospheric pressure and hence the spool 133 of the control valve 130 is located at the position shown in FIG. 9 by the biasing force of the spring 134. The advance passage 225 is closed by the check valve 80 and hence the working oil in the advance hydraulic chamber 56 is discharged through the control valve 130, the advance passage 226, the advance passage 223, the advance passage 220, and the discharge passage 206 to the drain 200. Because the working oil is supplied to the respective retard hydraulic chambers and is discharged from the respective advance hydraulic chambers in this manner, the vane rotor 15 receives the hydraulic pressure from three retard hydraulic chambers 51, 51, and 53 and rotates to the retard side with respect to the housing 10.

Figure 11:
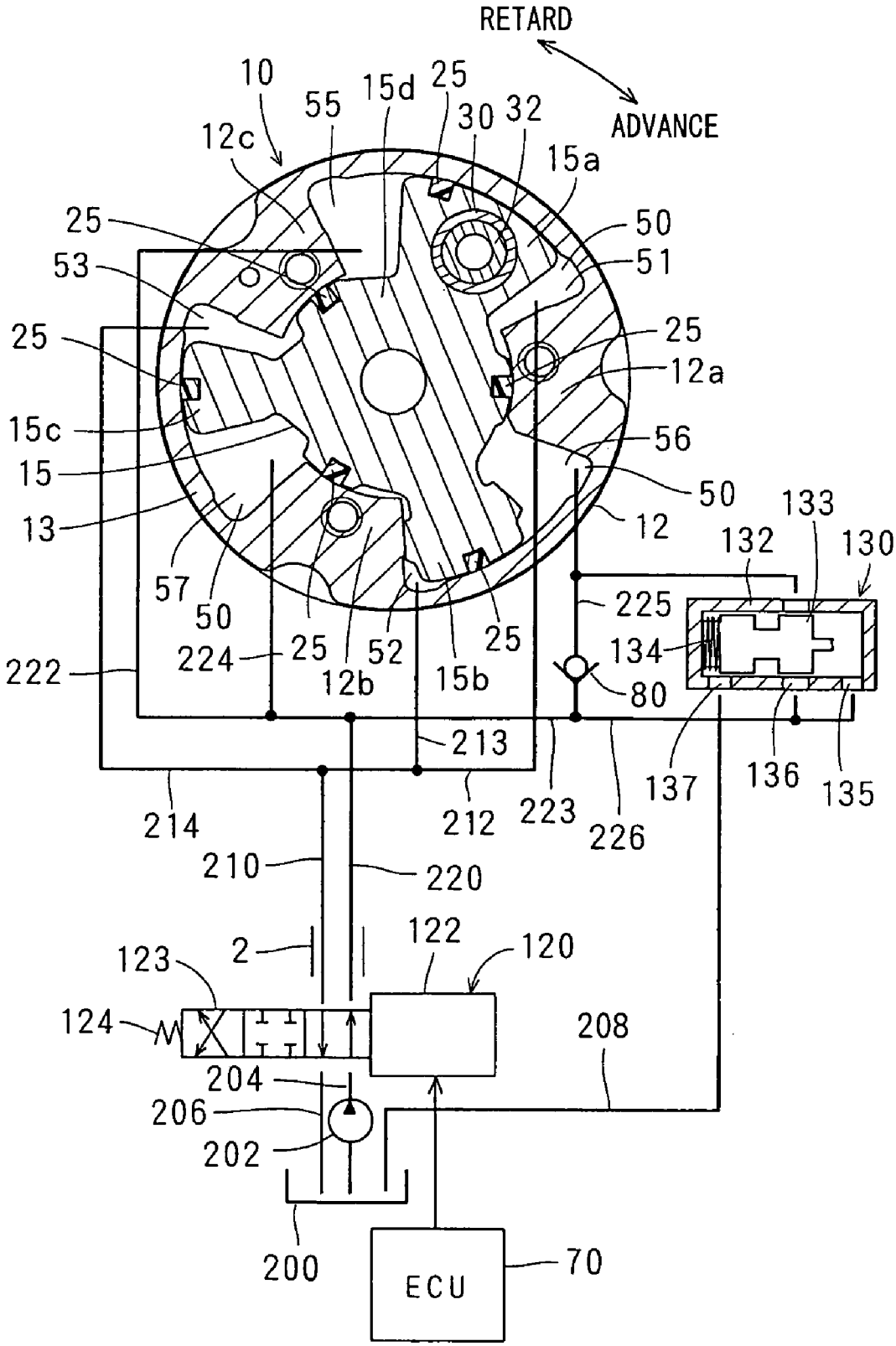
FIG. 11 is a sectional view showing the state of a valve timing controller at the time of performing an advance control.

Next, when the passage of current through the switching valve 120 is started to perform advance control, as shown in FIG. 11, the spool 123 is located at the position shown in FIG. 11 by the electromagnetic force of the electromagnetic driving part 122 which is applied to the spool 123 against the biasing force of the spring 124. In this state, the working oil is supplied from the supply passage 204 to the advance passage 220 and is supplied through the advance passages 222, 223, and 224 to the respective advance hydraulic chambers. In the case of the advance passage 223, the working oil is supplied through the check valve 80 and then the advance passage 225 to the advance hydraulic chamber 56. The working oil in the retard hydraulic chambers 51, 52, and 53 is discharged from the retard passages 212, 213, and 214 through the retard passage 210, the switching valve 120, and the discharge passage 206 to the drain 200.

The working oil is supplied from the advance passage 226 to the advance pressure port 135 of the control valve 130, so that the spool 133 of the control valve 130 is moved against the biasing force of the spring 134, thereby being located at the position shown in FIG. 11. Hence, the advance passage 226 is closed by the control valve 130.

In this manner, the working oil is supplied to the respective advance hydraulic chambers and is discharged from the respective retard hydraulic chambers, so that vane rotor 15 receives hydraulic pressure from three advance hydraulic chambers 55, 56, and 57 and rotates to the advance side with respect to the housing 10.

When the working oil is supplied to the respective advance hydraulic chambers and is discharged from the respective retard hydraulic chambers to perform the phase control to the target phase of the advance side, if the vane rotor 15 receives torque variation on the retard side, the working oil in the respective advance hydraulic chambers receive force to flow out to the advance passages 222, 223, and 224. However, the check valve 80 is disposed in the advance passage 225 and the advance passage 226 is closed by the control valve 130, so that the working oil does not flow out of the advance hydraulic chamber 56 to the advance passage 223. Hence, at the time of performing the advance control, even if the vane rotor 15 receives torque variation on the retard side when the hydraulic pressure of the oil pump 202 is low, the vane rotor 15 is not returned to the retard side. As a result, the working oil does not flow out of the advance hydraulic chambers 55, 57, either. Therefore, even if the vane rotor 15 receives torque variation on the retard side from the camshaft, it is possible to prevent the vane rotor 15 from being returned to the retard side opposite to the target phase, as shown in FIG. 23, and hence the vane rotor 15 can quickly reach the target phase of the advance side.

Figure 10:
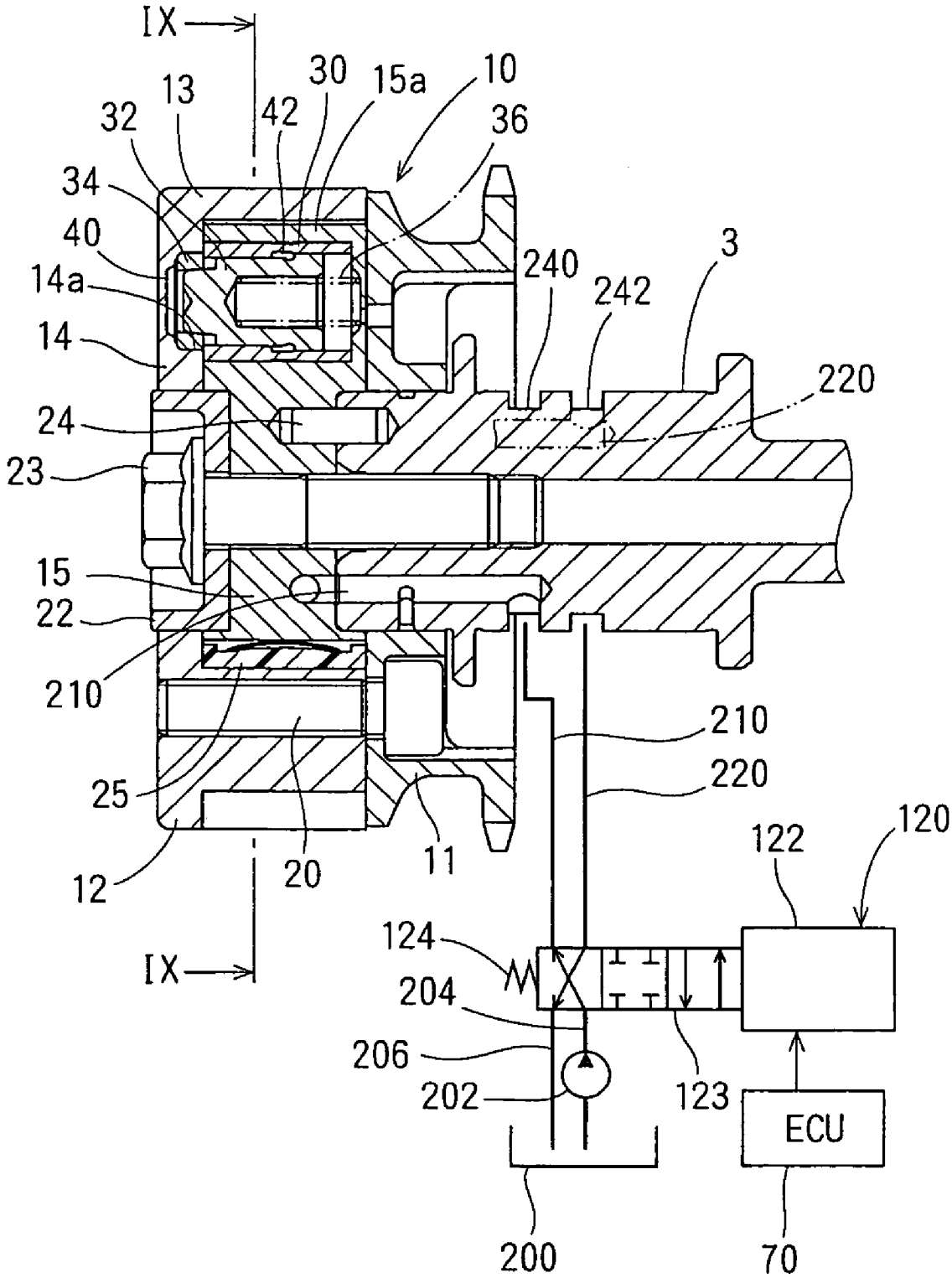
FIG. 10 is a longitudinal sectional view showing a valve timing controller in accordance with the sixth embodiment of the present invention.

In the sixth embodiment, at the time of performing the retard control of valve timing, the working oil in the advance hydraulic chamber 56 is discharged through the control valve 130 and at the time of performing the advance control of valve timing, the control valve 130 prohibits the working oil from being discharged from the advance hydraulic chamber 56. By disposing such control valve 130 closer to the advance hydraulic chamber 56 than the bearing 2, as shown in FIG. 10, the working oil passage passing through the camshaft 3 and the bearing 2 can be made to be two systems as is the case with construction having no check valve 80. Therefore, three systems of passages do not need to be formed in the camshaft 3 and the bearing 2 as is the case with the first embodiment, but even in the case of using the check valve 80, the camshaft 3 and the bearing 2 of the same passage construction as in the case of using the check valve 80 can be used.

Seventh Embodiment

Figure 12A:
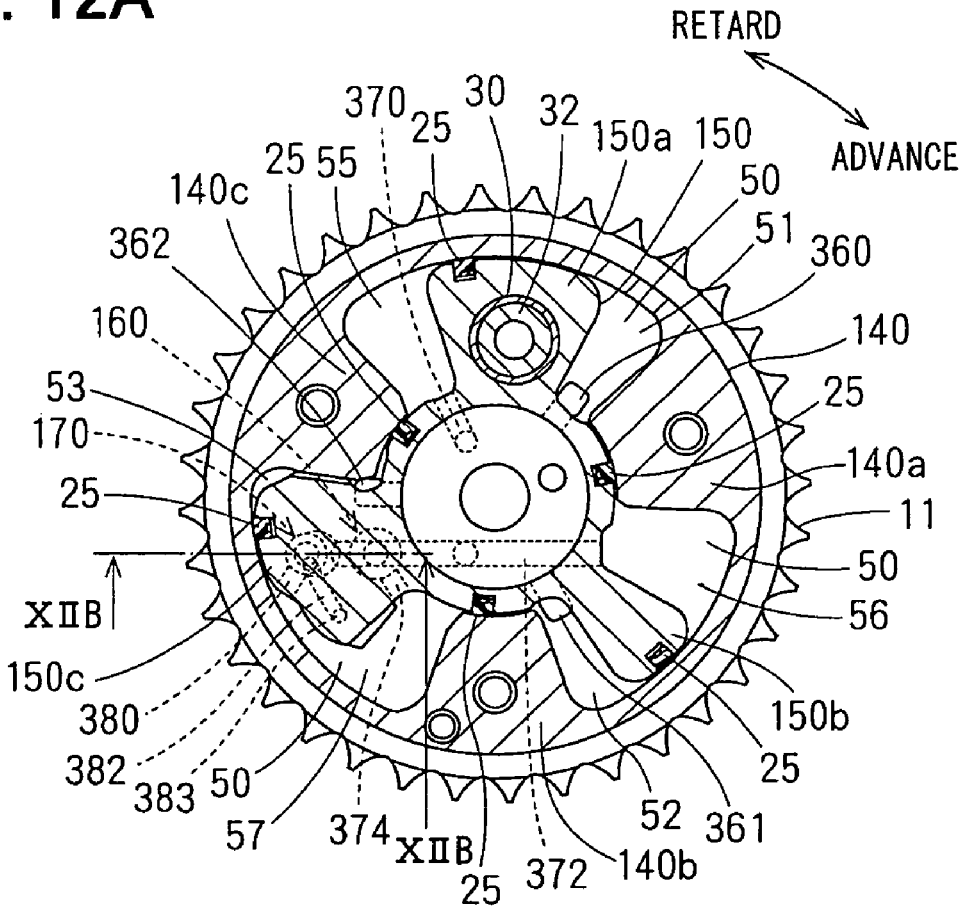
FIG. 12A is a sectional view showing a valve timing controller in accordance with the seventh embodiment of the present invention in the nearly same sectional position as in FIG. 1.

The seventh embodiment of the present invention is shown in FIGS. 12, 13. Here, the substantially same constituent parts as in the first embodiment are denoted by the same reference symbols. The seventh embodiment is an embodiment in which the check valve 80 and the control valve 130 in the sixth embodiment are disposed as a check valve 160 and a control valve 170 in a vane rotor 150, respectively.

The vane rotor 150 has three vanes 150*a*, 150*b*, and 150*c*. The respective vanes received in the receiving chambers 50, which are formed in the direction of rotation by the shoes 140*a*, 140*b*, and 140*c* of a shoe housing 140, partition the receiving chambers 50 into the retard hydraulic chamber 51 and the advance hydraulic chamber 55, the retard hydraulic chamber 52 and the advance hydraulic chamber 56, and the retard hydraulic chamber 53 and the advance hydraulic chamber 57.

Retard passages 360, 361, and 362 are formed on the opposite side of the vane rotor 150 of the chain sprocket 11. The working oil is supplied from the retard passages 360, 361, and 362 to the retard hydraulic chambers 51, 52, and 53. The working oil of the retard hydraulic chambers 51, 52, and 53 is discharged through the retard passages 360, 361, and 362. The retard passages 360, 361, and 362 serve as the retard supply passage and the retard discharge passage, respectively.

In the vane rotor 150 are formed advance passages 370, 372, 374, and 380. The working oil is supplied from the advance passages 370, 372 to the advance hydraulic chambers 55, 56 and the working oil in the advance hydraulic chambers 55, 56 is discharged from the advance passages 370, 372. The advance passages 370, 372 serve as the first advance passage and the second advance passage, respectively. The working oil is supplied through the advance passage 372, the check valve 160, and the advance passage 374 as the first advance passage to the advance hydraulic chamber 57. The working oil in the advance hydraulic chamber 57 is discharged through an advance passage 380 as the second advance passage, the check valve 170, and the advance passage 372. The advance passage 374 as the first advance passage and the advance passage 380 as the second advance passage separately connect with the advance hydraulic chamber 57, respectively.

The check valve 160, as shown in FIGS. 12A and 12B and FIGS. 13A and 13B, is disposed in the vane 150*c* of the vane rotor 150. The check valve 160 has a ball 162, a spring 163, a valve seat 164, and a spring seat 166. The spring 163 biases the ball 162 to the valve seat 164. The ball 162 reciprocates in the direction of the rotary shaft of the vane rotor 150.

When the ball 162 is seated on the valve seat 164, the check valve 160 prohibits the working oil in the advance hydraulic chamber 57 from flowing out of the advance passage 374 to the advance passage 372. When the ball 162 is separated from the valve seat 164, the check valve 160 allows the working oil to be supplied from the advance passage 372 through the advance passage 374 to the advance hydraulic chamber 57.

The control valve 170 has a spool 172 and a spring 173. The spring 173 biases the spool 172 upward in FIG. 12B, that is, in the direction that connects the advance passage 372 to the advance passage 374.

An atmospheric passage 382 is formed in the shape of an arc in such surface of the chain sprocket 11 that is opposed to the vane rotor 150 in such a way as to connect with a space that receives the spring 173 of the control valve 170 even when the vane rotor 150 turns relatively to the chain sprocket 11. An atmospheric passage 383 passes through the chain sprocket 11 and is open to the atmosphere. The atmospheric passage 383 connects with the atmospheric passage 382.

Figure 12B:
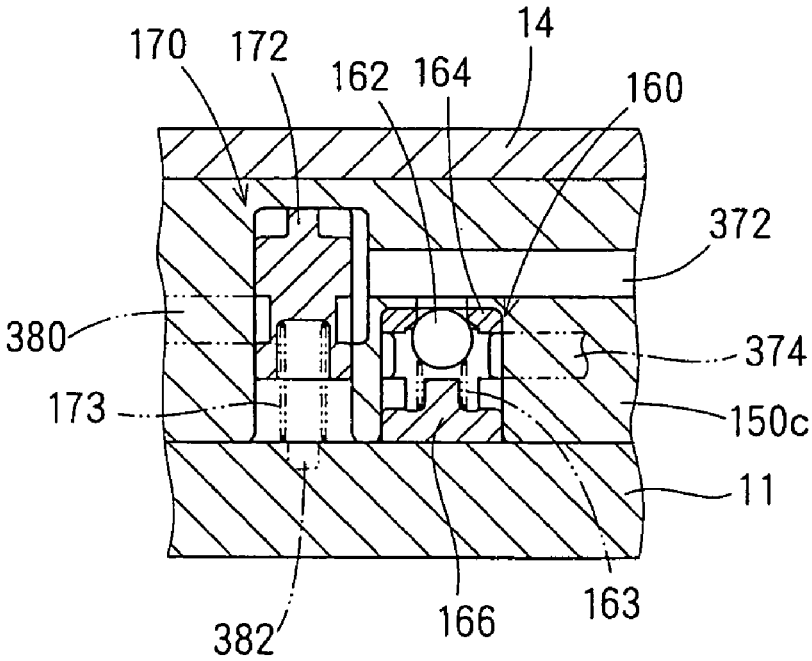
FIG. 12B is a sectional view taken on a line XIIB—XIIB in FIG. 12A.
Figure 13A:
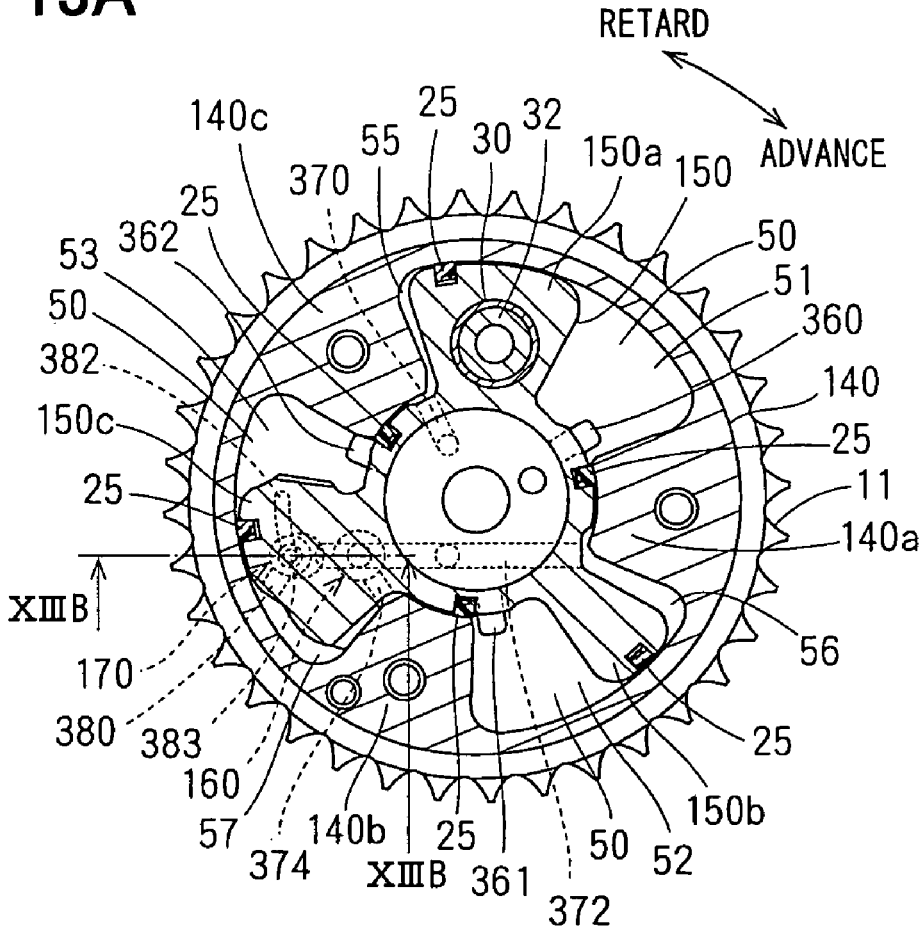
FIG. 13A is a sectional view showing a valve timing controller at the time of performing an advance control.

When the working oil is supplied to the retard passages 360, 361, 362 and is discharged from the advance passages 370, 372 at the time of performing the retard control of valve timing, the check valve 160 is closed as shown in FIG. 12B to interrupt the connection between the advance passage 372 and the advance passage 374. The working oil in the advance passage 372 is discharged to locate the spool 172 of the control valve 170 at the position shown in FIG. 12B by the biasing force of the spring 173. With this, the advance passage 372 connects with the advance passage 380 and hence the working oil in the advance hydraulic chamber 57 is discharged through the advance passage 380 and the control valve 170 to the advance passage 372.

Figure 13B:
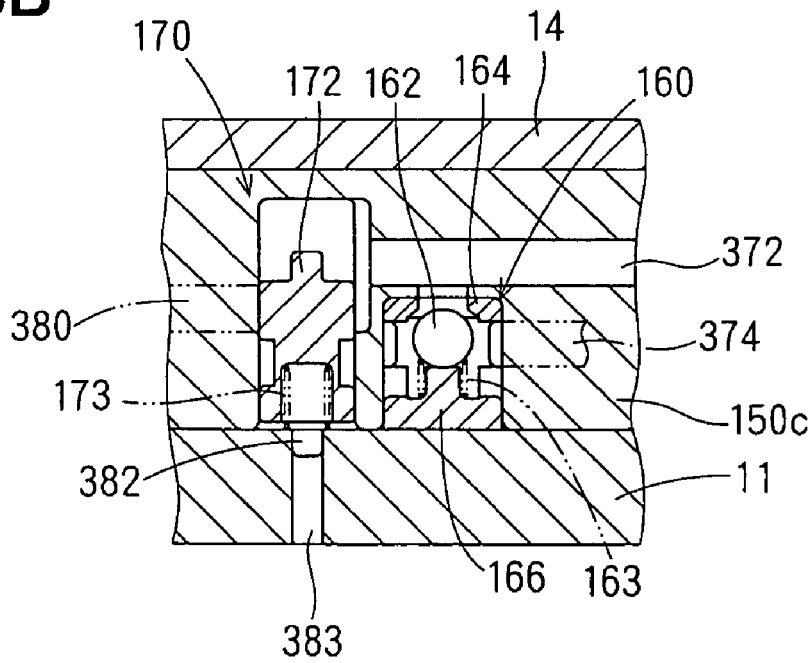
FIG. 13B is a sectional view taken on a line XIIIB—XIIIB in FIG. 13A.

On the other hand, when the working oil is discharged from the retard passages 360, 361, 362 and is supplied to the advance passages 370, 372 at the time of performing the advance control of valve timing, the check valve 160 is opened as shown in FIG. 13B. The working oil in the advance passage 372 is supplied through the check valve 160, the advance passage 374 to the advance hydraulic chamber 57.

Because the working oil is supplied to the advance passage 372, the spool 172 of the control valve 170 is located at the position shown in FIG. 13 B against the biasing force of the spring 173. With this, the connection between the advance passage 372 and the advance passage 380 is interrupted and hence the working oil in the advance hydraulic chamber 57 is not discharged through the control valve 170 to the advance passage 372.

In the seventh embodiment, the ball 162 is displaced in the direction of the rotary shaft of the vane rotor 150 to interrupt the connection between the advance passage 372 and the advance passage 374 and hence the centrifugal fore developed by the rotation of the vane rotor 150 is not applied in the direction in which the ball 162 is moved. Therefore, the check valve 160 operates with almost no suffering of the effect of the centrifugal force.

Further, because the check valve 160 is disposed in the vane 150*c* of the vane rotor 150, the length of passage between the advance hydraulic chamber 57 and the check valve 160 is made short. With this, dead volume produced by the advance passage 374 between the advance hydraulic chamber 57 and the check valve 160 is reduced. Hence, even if the vane rotor 150 receives torque variation at the time of performing the phase control, a pressure drop in the advance hydraulic chamber 57 having the working oil supplied thereto can be prevented. Therefore, the responsivity of the phase control to the advance side can be improved.

Eighth Embodiment

Figure 14:
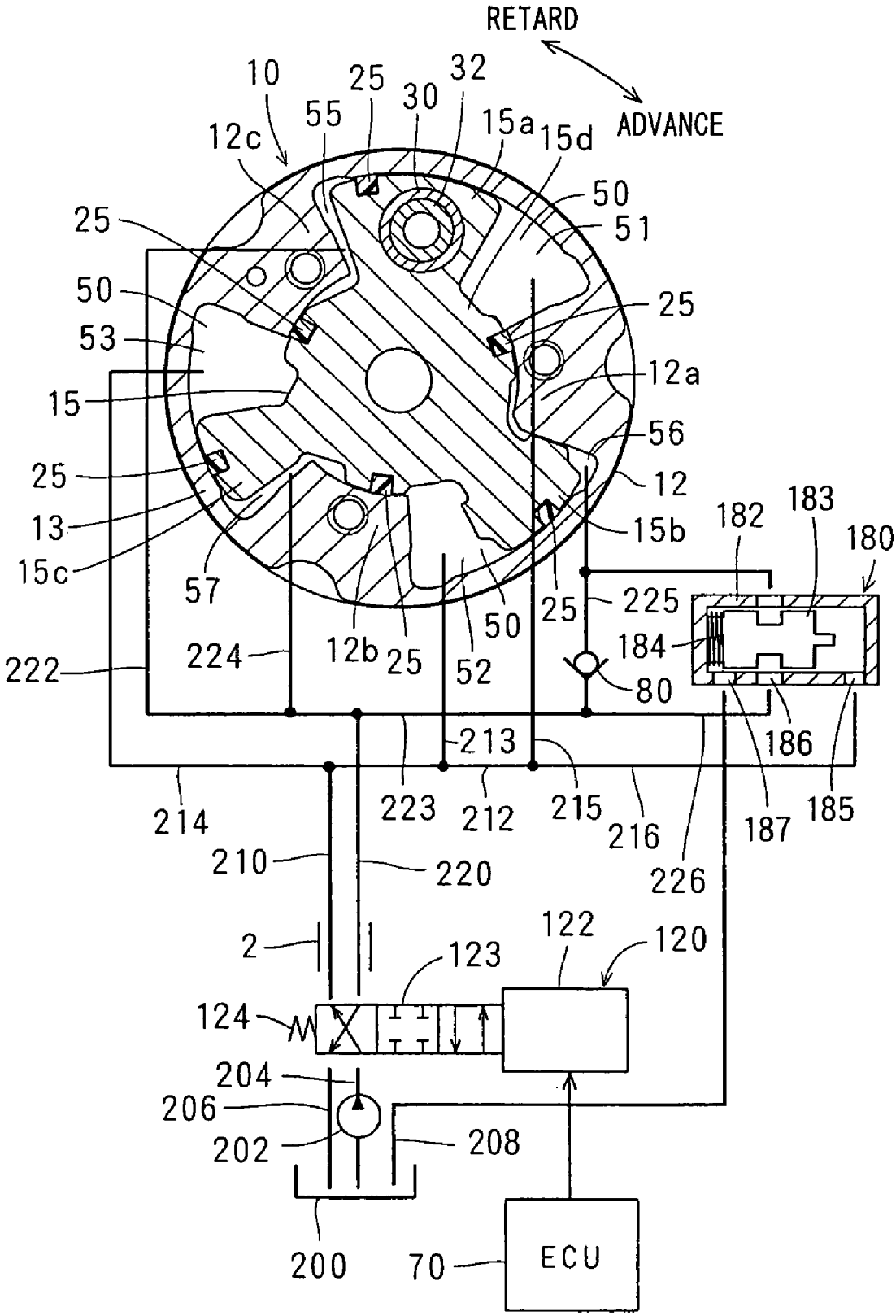
FIG. 14 is a sectional view showing a valve timing controller in accordance with the eighth embodiment of the present invention in the same sectional position as in FIG. 1.

The eighth embodiment of the present invention is shown in FIG. 14. Here, the substantially same constituent parts as in the sixth embodiment are denoted by the same reference symbols.

The retard passage 212 is branched to the retard passage 215 connecting with the retard hydraulic chamber 51 and the retard passage 216 connecting with the retard pressure port 185 of a control valve 180.

The control valve 180 is a spool valve receiving a spool 183 in a housing 182 such that the spool 183 freely reciprocates and is disposed closer to the advance hydraulic chamber 56 than the bearing 2. A spring 184 biases the spool 183 in one direction of reciprocating directions. In the housing 182 are formed a retard pressure port 185, a discharge port 186, and an open port 187. The working oil is supplied from the retard passage 215 to the retard pressure port 185. The discharge port 186 connects with the advance passage 226. The open port 187 connects with the discharge passage 208 and is open to the drain 200.

In the retard control state shown in FIG. 14 in which the passage of current through the switching valve 120 is stopped, the working oil is supplied from the supply passage 204 to the retard passage 210 and then is supplied through the retard passages 212, 213, and 214 to the respective retard hydraulic chambers. In this state, the working oil in the advance hydraulic chambers 55, 57 is discharged from the advance passages 222, 224 through the advance passage 220, the switching valve 120, and the discharge passage 206 to the drain 200.

Then, the working oil is supplied to the retard pressure port 185 of the control valve 180 connecting with the retard passage 216 and hence the spool 183 in the control valve 180 is located as the position shown in FIG. 14 against the biasing force of the spring 184. Hence, the control valve 180 opens the advance passage 226. Because the check valve 80 is disposed in the advance passage 225, the working oil in the advance hydraulic chamber 56 is discharged through the control valve 180, the advance passage 226, the advance passage 223, the advance passage 220, and the discharge passage 206 to the drain 200. In this manner, the working oil is supplied to the respective retard hydraulic chambers and is discharged from the respective advance hydraulic chambers, so that the vane rotor 15 receives hydraulic pressure from three retard hydraulic chambers 51, 52, and 53 and rotates to the retard side with respect to the housing 10.

Next, when the passage of current through the switching valve 120 is started to perform the advance control, the working oil is supplied from the supply passage 204 to the advance passage 220 and then is supplied through the advance passages 222, 223, and 234 to the respective advance hydraulic chambers. In the case of the advance passage 223, the working oil is supplied through the check valve 80 and the advance passage 225 to the advance hydraulic chamber 56. The working oil in the retard hydraulic chambers 51, 52, and 53 is discharged from the retard passages 212, 213, and 214 through the retard passage 210, the switching valve 120, and the discharge passage 206 to the drain 200.

The working oil is not supplied from the retard passage 216 to the retard pressure port 185 of the control valve 180 and hence the spool 183 of the control valve 180 is moved to the right in FIG. 14 by the biasing force of the spring 184. Hence, the control valve 180 closes the advance passage 226.

In this manner, the working oil is supplied to the respective advance hydraulic chambers and is discharged from the respective retard hydraulic chambers, so that the vane rotor 15 receives hydraulic pressure from three advance hydraulic chambers 55, 56, and 57 and rotates to the advance side with respect to the housing 10.

Ninth Embodiment

Figure 15:
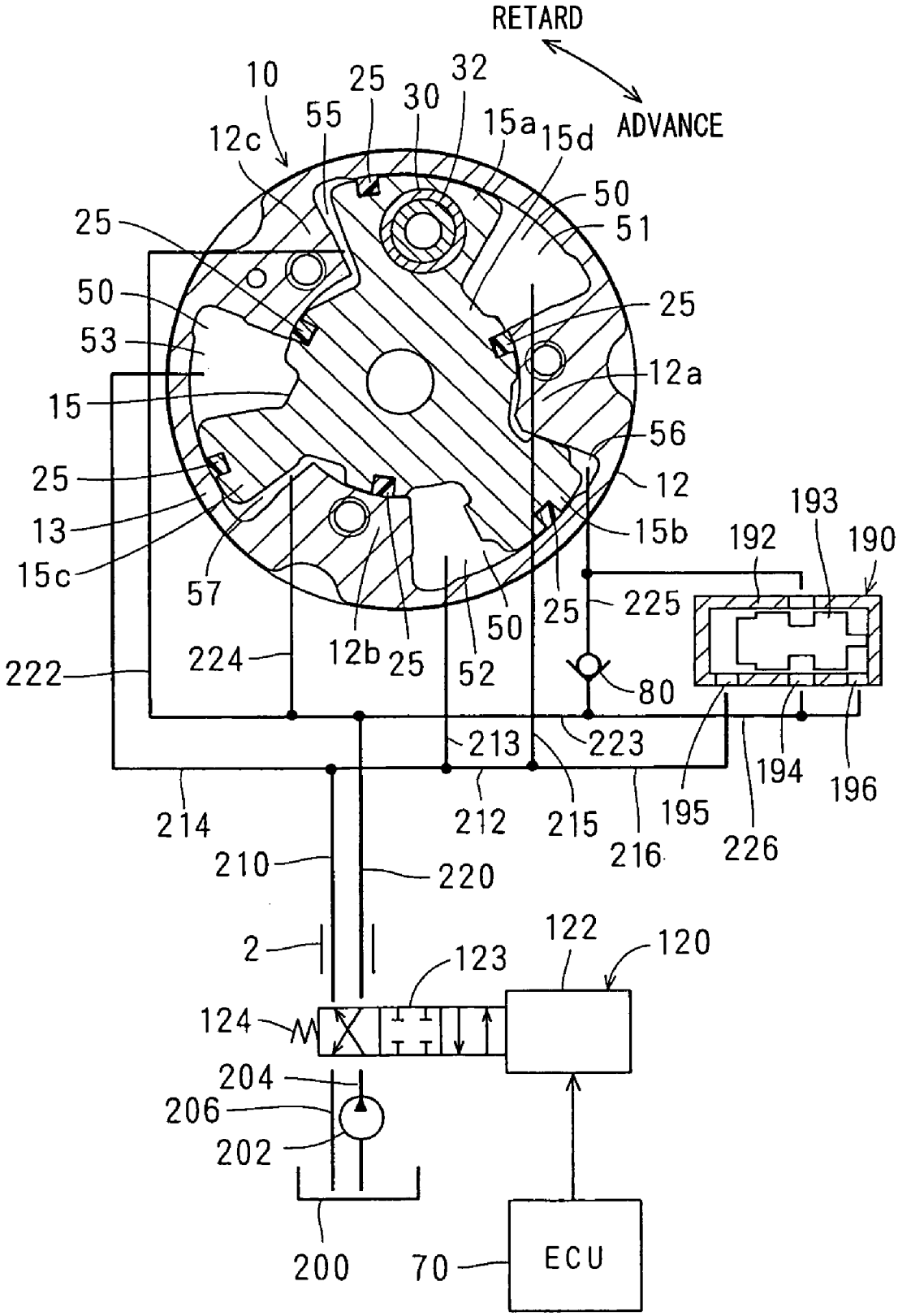
FIG. 15 is a sectional view showing a valve timing controller in accordance with the ninth embodiment of the present invention in the same sectional position as in FIG. 1.

The ninth embodiment of the present invention is shown in FIG. 15. Here, the substantially same constituent parts as in the sixth and eighth embodiments are denoted by the same reference symbols.

A control valve 190 is a spool valve receiving a spool 193 in a housing 192 such that the spool 193 freely reciprocates and is disposed closer to the advance hydraulic chamber 56 than the bearing 2. In the housing 192 are formed a discharge port 194, a retard pressure port 195, and an advance pressure port 196. The discharge port 194 connects with the advance passage 226. The retard pressure port 195 has hydraulic pressure applied from the retard passage 216, and the retard pressure port 196 has hydraulic pressure applied from the oil pump 202 rather than the check valve 80 of the advance passage 225. The hydraulic pressure applied to the retard pressure port 195 and the advance pressure port 196 is applied in a direction opposite to the spool 193.

In the retard control state shown in FIG. 15 in which the passage of current through the switching valve 120 is stopped, the working oil is supplied from the supply passage 204 to the retard passage 210 and then is supplied through the retard passages 212, 213, and 214 to the respective retard hydraulic chambers. In this state, the working oil in the advance hydraulic chambers 55, 57 is discharged from the advance passages 222, 224 through the advance passage 220, the switching valve 120, and the discharge passage 206 to the drain 200.

The working oil is supplied from the retard passage 216 to the retard pressure port 195 of the control valve 190 and is not supplied from the advance passage 226 to the advance pressure port 196, so that the spool 193 is located at the position shown in FIG. 15. Hence, the control valve 190 opens the advance passage 226. Because the check valve 80 is disposed in the advance passage 225, the working oil in the advance hydraulic chamber 56 is discharged through the control valve 190, the advance passage 226, the advance passage 223, the advance passage 220, and the discharge passage 206 to the drain 200. In this manner, the working oil is supplied to the respective retard hydraulic chambers and is discharged from the respective advance hydraulic chambers, so that the vane rotor 15 receives hydraulic pressure from three retard hydraulic chambers 51, 52, and 53 and rotates to the retard side with respect to the housing 10.

Next, when the passage of current through the switching valve 120 is started to perform the advance control, the working oil is supplied from the supply passage 204 to the advance passage 220 and then is supplied through the advance passages 222, 223, and 234 to the respective advance hydraulic chambers. In the case of the advance passage 223, the working oil is supplied through the check valve 80 and the advance passage 225 to the advance hydraulic chamber 56. The working oil in the retard hydraulic chambers 51, 52, and 53 is discharged from the retard passages 212, 213, and 214 through the retard passage 210, the switching valve 120, and the discharge passage 206 to the drain 200.

The working oil is not supplied from the retard passage 216 to the retard pressure port 195 of the control valve 190 and is supplied from the advance passage 226 to the advance pressure port 196, so that the spool 193 of the control valve 190 is moved to the left in FIG. 15. Hence, the control valve 190 opens the advance passage 226.

In this manner, the working oil is supplied to the respective advance hydraulic chambers and is discharged from the respective retard hydraulic chambers, so that the vane rotor 15 receives hydraulic pressure from three advance hydraulic chambers 55, 56, and 57 and rotates to the advance side with respect to the housing 10.

Tenth Embodiment

Figure 16A:
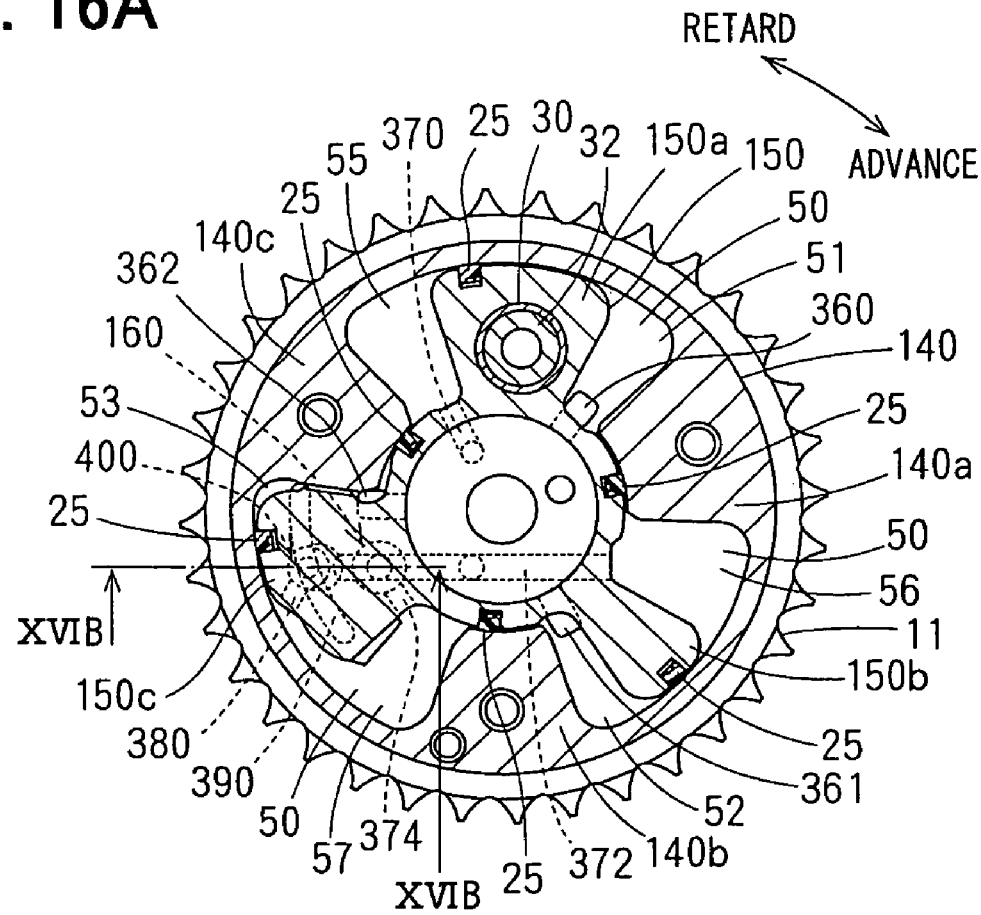
FIG. 16A is a sectional view showing a valve timing controller in accordance with the tenth embodiment of the present invention in the nearly same sectional position as in FIG. 1.
Figure 16B:
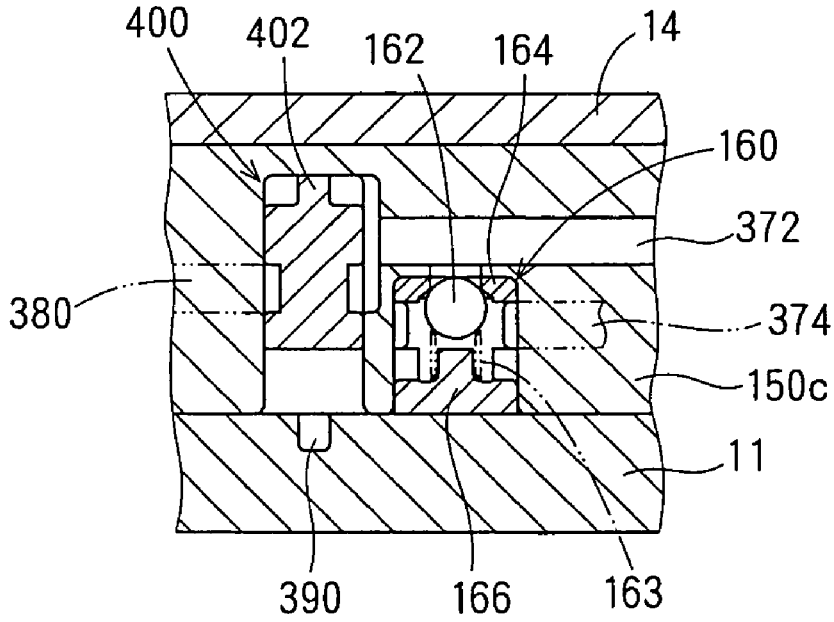
FIG. 16B is a sectional view taken on a line XVIB—XVIB in FIG. 16A.
Figure 17A:
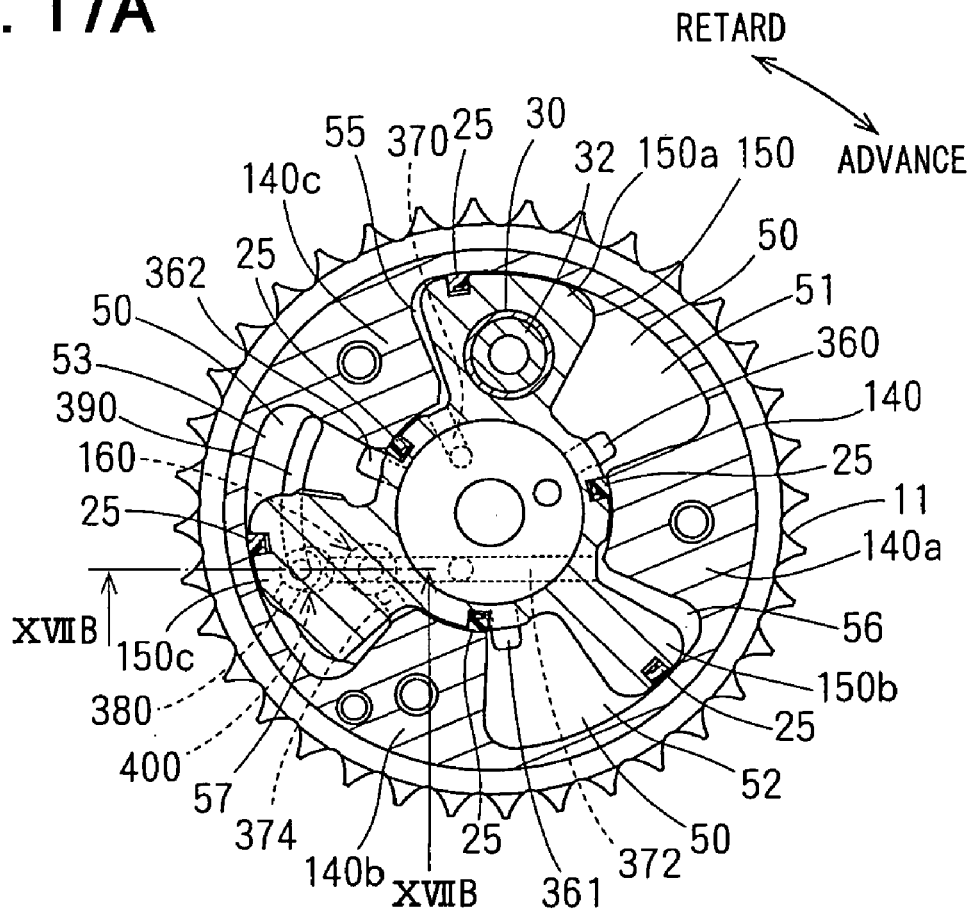
FIG. 17A is a sectional view showing the state of a valve timing controller at the time of performing an advance control.

The tenth embodiment of the present invention is shown in FIGS. 16, 17. Here, the substantially same constituent parts as in the seventh embodiment are denoted by the same reference symbols. The tenth embodiment is an embodiment in which in place of the control valve 170 in the seventh embodiment, the control valve 190 in the ninth embodiment is disposed as a control valve 400 in the vane rotor 150.

The control valve 400 has a spool 402. Hydraulic pressure applied to the spool 402 from an advance passage 372 is opposite in direction to hydraulic pressure applied to the spool 402 from a retard passage 390 connecting with the retard hydraulic chamber 53. The retard passage 390 is formed in the shape of an arc in such surface of the chain sprocket 11 that is opposed to the vane rotor 150 in such a way as to connect with a space below in FIG. 16B of the control valve 400 even if the vane rotor 150 turns relatively to the chain sprocket 11.

When the working oil is supplied to the retard passages 360, 361, and 362 and is discharged from the advance passages 370, 372 at the time of performing the retard control of valve timing, the check valve 160 is closed as shown in FIG. 16B. Then, the working oil is supplied from the retard passage 390 and is discharged from the advance passage 372 and hence the spool 402 of the control valve 400 is located at the position shown in FIG. 16B. With this, the advance passage 372 connects with the advance passage 380, so that the working oil in the advance hydraulic chamber 57 is discharged through the advance passage 380, the control valve 400 to the advance passage 372.

Figure 17B:
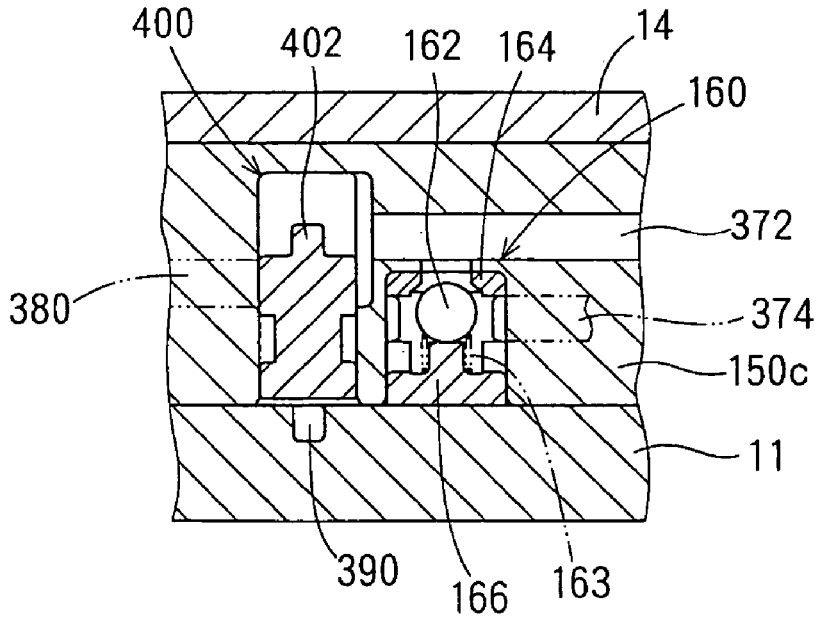
FIG. 17B is a sectional view taken on a line XVIIB—XVIIB in FIG. 17A.

On the other hand, when the working oil is discharged from the retard passages 360, 361, and 362 and is supplied to the advance passages 370, 372 at the time of performing the advance control of valve timing, the check valve 160 is opened as shown in FIG. 17B. Then, the working oil in the advance passage 372 is supplied from the check valve 160 through the advance passage 374 to the advance hydraulic chamber 57.

The working oil is supplied to the advance passage 372 and is discharged from the retard passage 390 and hence the spool 402 of the control valve 400 is located at the position shown in FIG. 17B. With this, the connection between the advance passage 372 and the advance passage 380 is interrupted, so that the working oil in the advance hydraulic chamber 57 is not discharged through the control valve 400 to the advance passage 372.

Eleventh Embodiment

Figure 18A:
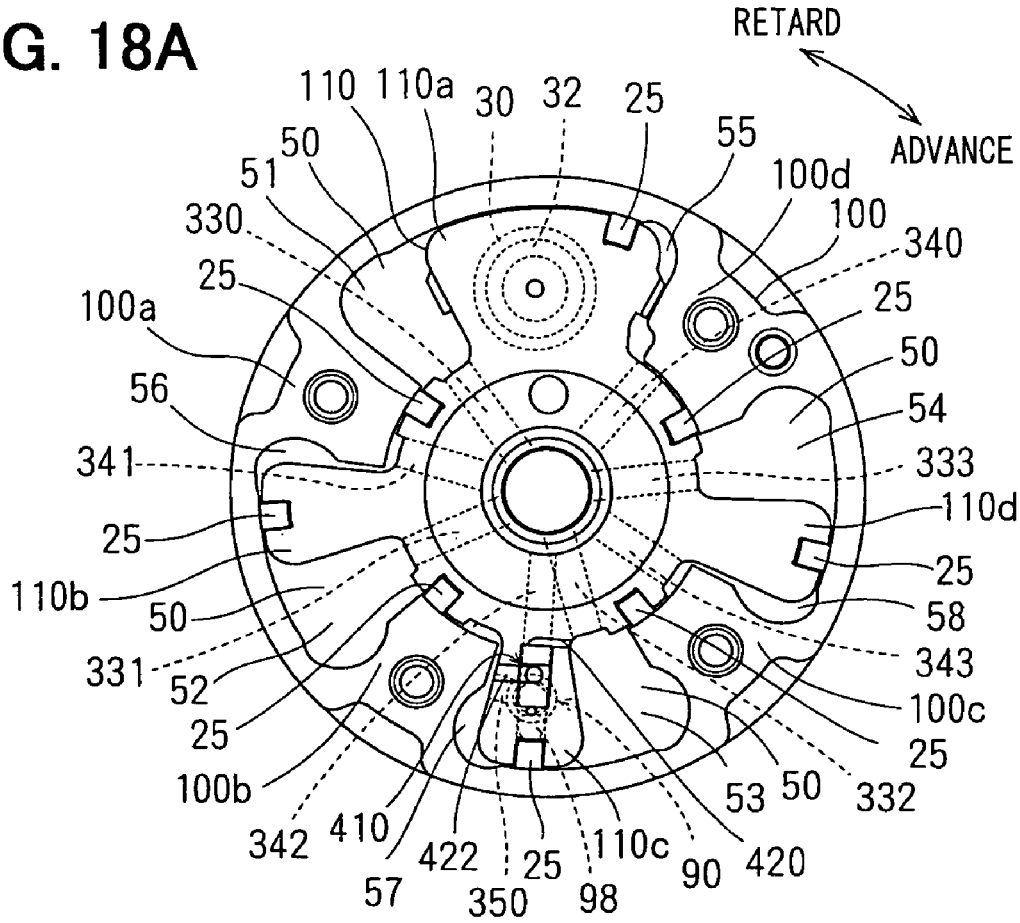
FIG. 18A is a view when viewed from the direction of arrow XVIIIA with a chain sprocket in FIG. 18B removed.
Figure 18B:
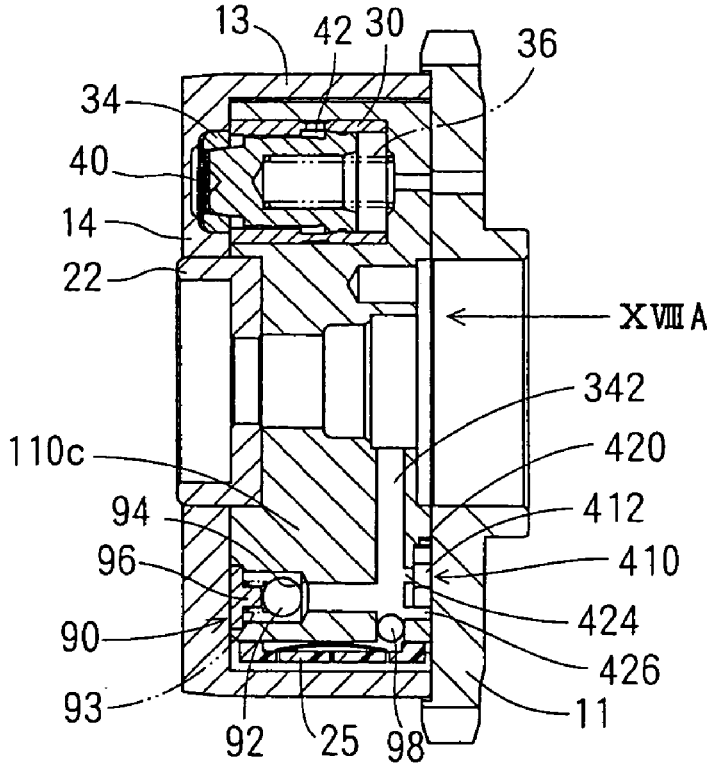
FIG. 18B is a longitudinal sectional view showing a valve timing controller in accordance with the eleventh embodiment.

The eleventh embodiment of the present invention is shown in FIGS. 18, 19. The eleventh embodiment is an embodiment in which a control valve 410 is disposed in the vane 110*c* in addition to the check valve 90 in the fifth embodiment. However, the advance passage 352 in the fifth embodiment is not formed in the eleventh embodiment. The other construction is substantially the same as in the fifth embodiment. FIG. 18A is a view when FIG. 18B is viewed from the chain sprocket 11 with the chain sprocket 11 removed. In FIG. 18B, the ball 92 of the check valve 90 reciprocates in the direction of the rotary shaft of the vane rotor 110, which is a left and right direction in FIG. 18B, and a valve element 412 of the control valve 410 reciprocates in a direction perpendicular to the rotary shaft, which is an up and down direction in FIG. 18B.

Figure 19A:
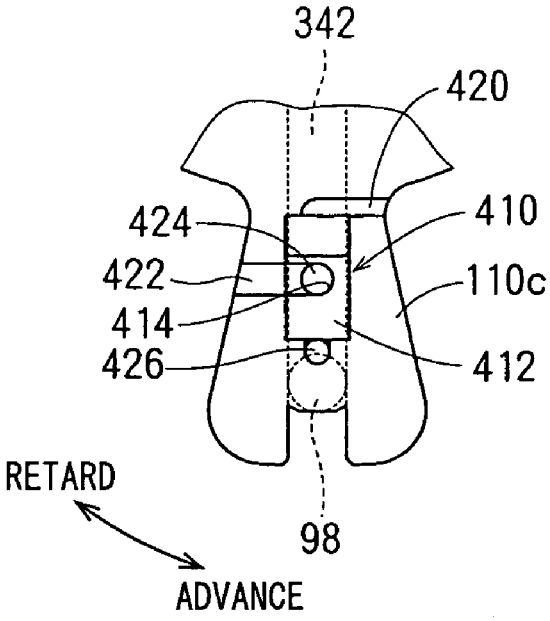
FIG. 19A is an illustration showing the state of a control valve at the time of performing a retard control.
Figure 19B:
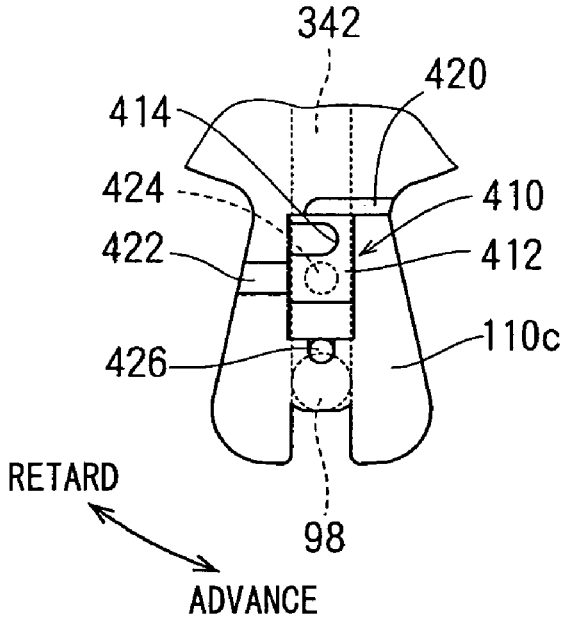
FIG. 19B is an illustration showing the state of a control valve at the time of performing an advance control.

As shown in FIGS. 19A and 19B, the valve element 412 of the control valve 410 is formed in the shape of a plate and hydraulic pressure is applied to both ends of the valve element 412 in opposite directions from a retard passage 420 and an advance passage 426. The advance passages 424, 426 connect with the advance passage 342. The retard passage 420 connects with the retard hydraulic chamber 53 and an advance passage 422 connects with the advance hydraulic chamber 57. The valve element 412 has a notch 414, which is formed in the shape of a letter U and closer to the retard passage 420 than the center. In the eleventh embodiment, the advance passage 342 serves as the first advance passage and the second advance passage. Moreover, the advance passages 422, 424 are the second advance passage.

At the time of performing the retard control of valve timing, the working oil is supplied from the retard hydraulic chamber 53 to the retard passage 420 and is discharged from the advance passage 426 through the advance passage 342, so that the valve element 412 is located at the position shown in FIG. 19A. In this state, the notch 414 of the valve element 412 connects the advance passage 422 with the advance passage 424 and hence the working oil in the advance hydraulic chamber 57 is discharged through the advance passage 422, the control valve 410, the advance passage 424, and the advance passage 342.

At the time of performing the advance control of valve timing, the working oil is discharged from the retard passage 420 and is supplied from the advance passage 342 to the advance passage 426, so that the valve element 412 is located at the position shown in FIG. 19B. In this state, the valve element 412 interrupts the connection between the advance passage 422 and the advance passage 424.

In the eleventh embodiment, the plate-shaped valve element 412 is used for the control valve 410 and hence space occupied by the control valve 410 is reduced. Moreover, the ball 92 of the check valve 90 and the valve element 412 of the control valve 410 reciprocate in the directions perpendicular to each other, so that the check valve 90 and the control valve 410 can be mounted in the vane 110*c* in tandem in the direction of the rotary shaft. With this, space occupied in the peripheral direction by the check valve 90 and the control valve 410 is reduced. Therefore, even in a case where the vanes except for the vane 110*a* are narrow in width in the peripheral direction because four vanes are mounted, as is the case with the eleventh embodiment, the check valve 90 and the control valve 410 can be mounted in one vane 110*c*.

Twelfth Embodiment

Figure 20:
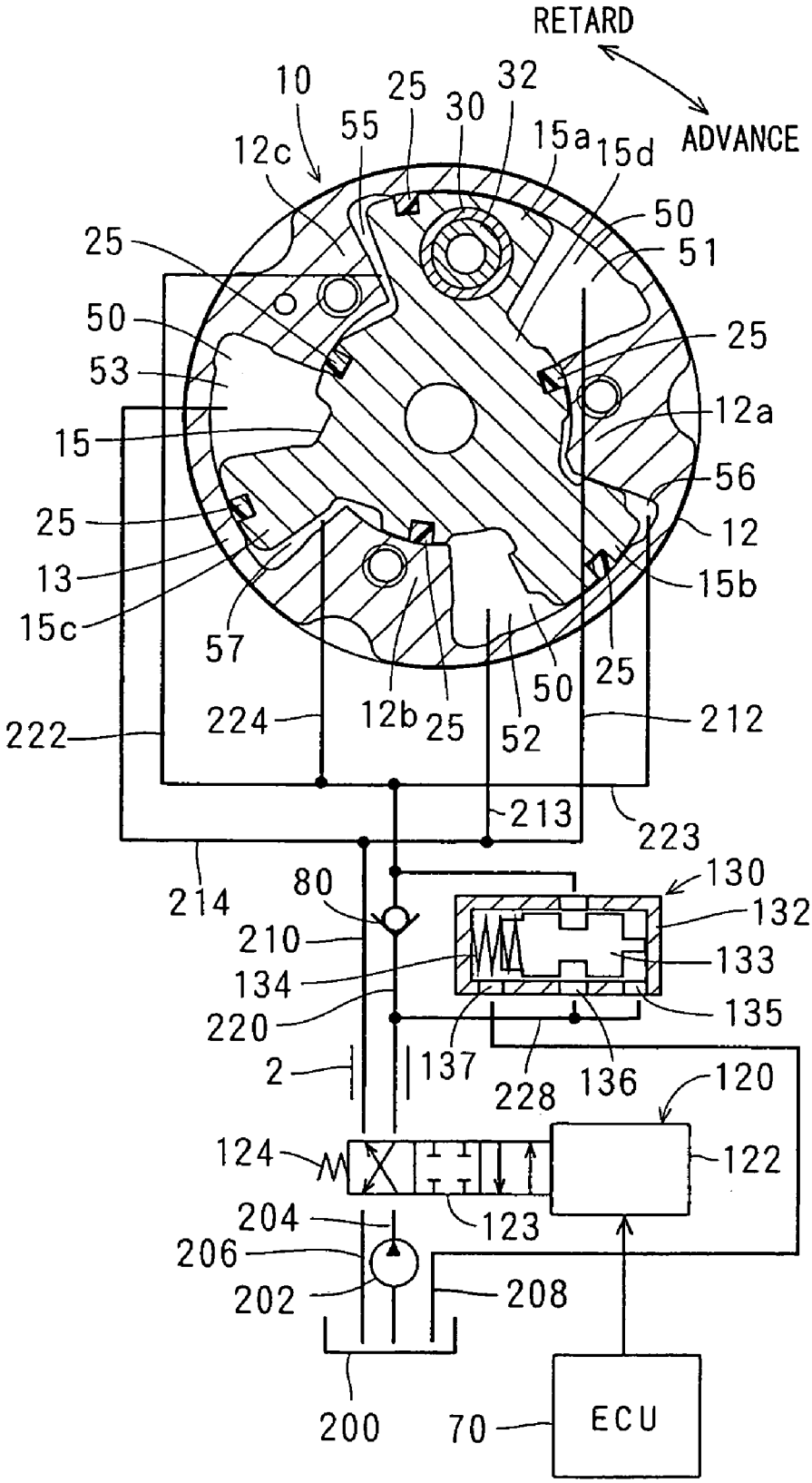
FIG. 20 is a sectional view showing a valve timing controller in accordance with the twelfth embodiment of the present invention in the same sectional position as in FIG. 1.

The twelfth embodiment of the present invention is shown in FIG. 20. Here, the substantially same constituent parts as in the sixth embodiment are denoted by the same reference symbols.

The check valve 80, as is the case with the fourth embodiment, is disposed in the advance passage 220 where the advance passages 222, 223, and 224 meet on the oil pump 202 side. Hence, when the working oil is supplied to the respective advance hydraulic chambers to perform the advance control, if the vane rotor 15 receives torque variation on the retard side, the check valve 80 prevents the working oil from flowing out of the respective advance hydraulic chambers.

The advance passage 228 as the second advance passage bypasses the check valve 80 and connects with the advance hydraulic chamber side of the check valve 80 and the oil pump 202. The discharge port 136 of the control valve 130 connects with the advance passage 228. The working oil is supplied from the advance passage 228 to the advance pressure port 135 of the control valve 130.

At the time of performing the retard control of valve timing, the spool 133 of the control valve 130 is located at the position shown in FIG. 20 to open the advance passage 228. Hence, the working oil of the respective advance hydraulic chambers is discharged through the control valve 130 and the advance passage 228 from the advance passage 220.

At the time of performing the advance control of valve timing, the spool 133 of the control valve 130 is moved to the left from the position shown in FIG. 20 to close the advance passage 228.

Thirteenth Embodiment

Figure 21:
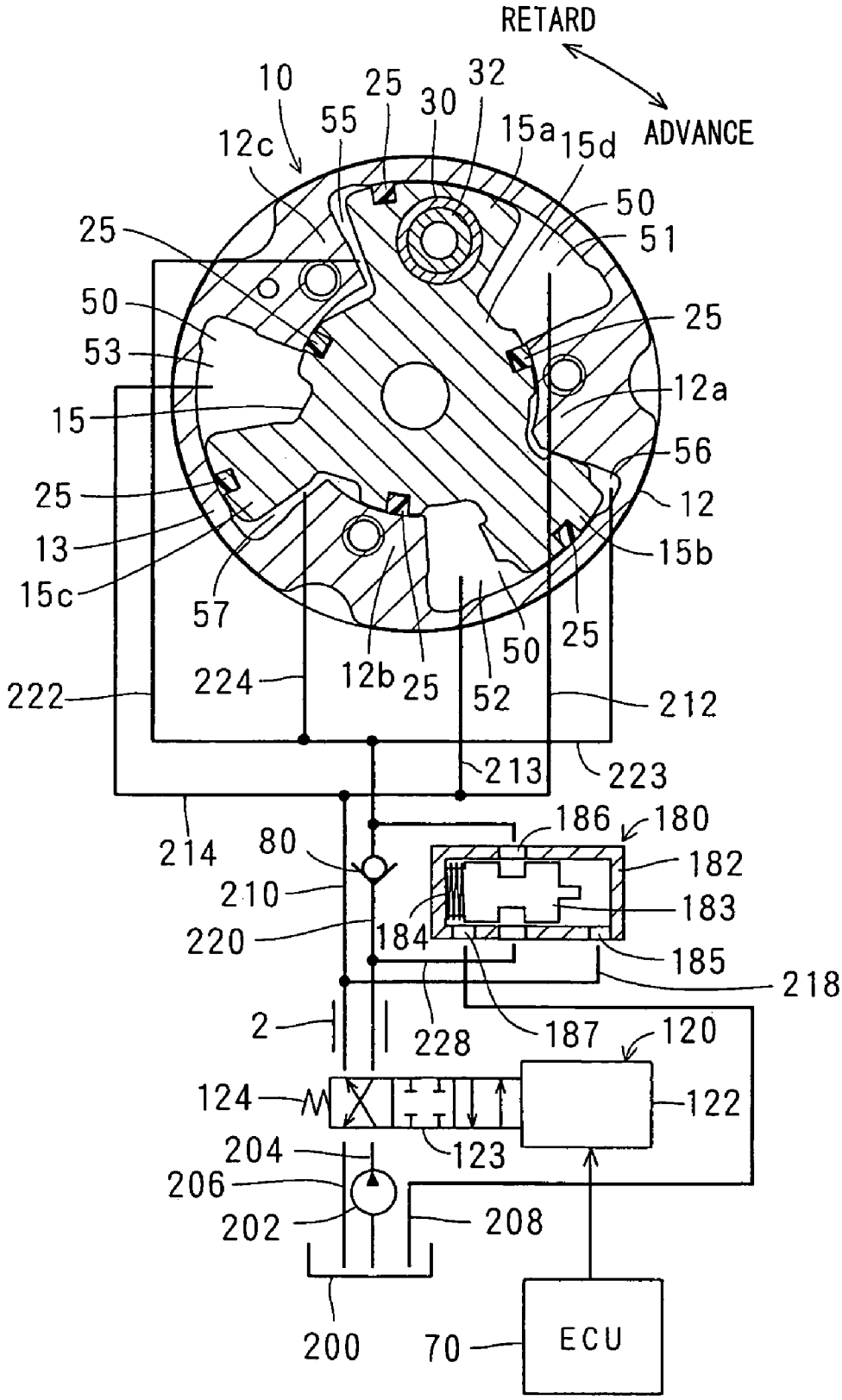
FIG. 21 is a sectional view showing a valve timing controller in accordance with the thirteenth embodiment of the present invention in the same sectional position as in FIG. 1.

The thirteenth embodiment of the present invention is shown in FIG. 21. The thirteenth embodiment is an embodiment in which he control valve 130 in the twelfth embodiment is replaced by the control valve 180 and the other construction is substantially the same as in the twelfth embodiment.

The working oil is supplied from the retard passage 218 connecting with the retard passages 210 to the retard pressure port 185 of the control valve 180. The discharge port 186 connects with the advance passage 228.

At the time of performing the retard control of valve timing, the working oil is supplied from the retard passages 210, 218 to the retard pressure port 185 and hence the spool 183 of the control valve 180 is located at the position shown in FIG. 21 against the biasing force of the spring 184 and the control valve 180 opens the advance passage 228. Hence, the working oil of the respective advance hydraulic chambers is discharged through the control valve 180 from the advance passage 220.

At the time of performing the advance control of valve timing, the working oil is not supplied from the retard passages 218 to the retard pressure port 185 and hence the spool 183 of the control valve 180 is located to the right from the position shown in FIG. 21 to close the advance passage 228.

Fourteenth Embodiment

Figure 22:
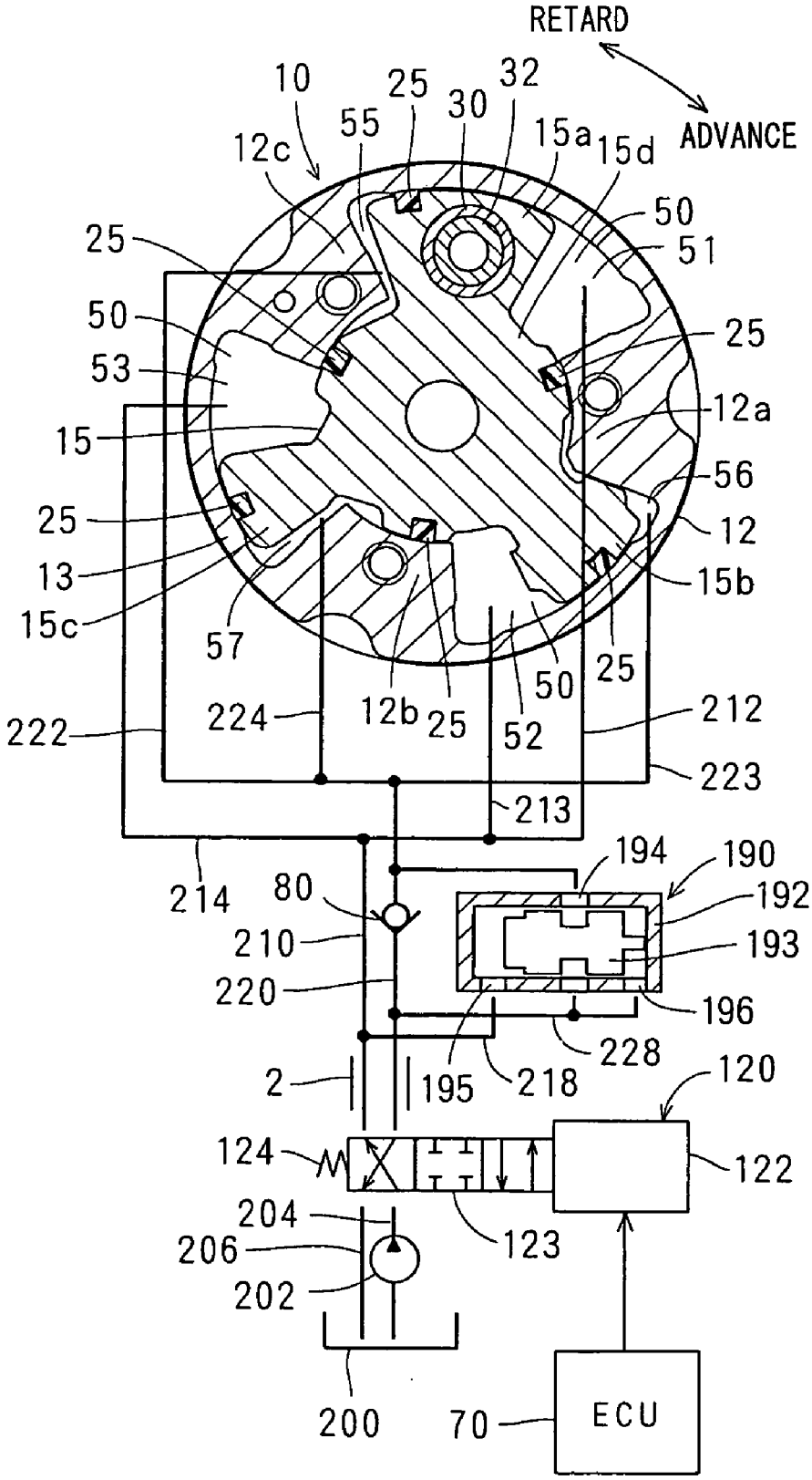
FIG. 22 is a sectional view showing a valve timing controller in accordance with the fourteenth embodiment of the present invention in the same sectional position as in FIG. 1.

The fourteenth embodiment of the present invention is shown in FIG. 22. The fourteenth embodiment is an embodiment in which the control valve 130 in the twelfth embodiment is replaced by the control valve 190 and the other construction is substantially the same as in the twelfth embodiment.

The working oil is supplied from the retard passage 218 connecting with the retard passage 210 to the retard pressure port 195 of the control valve 190. The working oil is supplied from the advance passage 228 connecting with the advance passage 220 to the advance pressure port 196. The discharge port 194 connects with the advance passage 228.

At the time of performing the retard control of valve timing, the working oil is supplied from the retard passages 218 to the retard pressure port 195 and the working oil is not supplied from the advance passage 228 to the advance pressure port 196. Therefore, the spool 193 of the control valve 190 is located at the position shown in FIG. 22 and the control valve 190 opens the advance passage 228. Hence, the working oil of the respective advance hydraulic chambers is discharged through the control valve 190 from the advance passage 220.

At the time of performing the advance control of valve timing, the working oil is not supplied from the retard passages 218 to the retard pressure port 195 and is supplied from the advance passage 228 to the advance pressure port 196, and hence the spool 193 of the control valve 190 is located to the left from the position shown in FIG. 22 to close the advance passage 228.

In the plurality of embodiments of the present invention described above, a check valve that allows the working oil from flowing from the oil pump to the advance hydraulic chamber and prohibits the working oil from flowing from the advance hydraulic chamber to the oil pump is disposed in a supply passage for supplying the working oil to at least one advance hydraulic chamber. With this, in the case of performing the phase control to the advance side, even if the vane rotor receives torque variation on the retard side, it is possible to prevent the vane rotor from returning to the retard side opposite to the target phase of the advance side. As a result, the vane rotor can quickly reach the target phase and hence the responsivity of the phase control to the advance side can be improved.

Further, the plurality of retard hydraulic chambers and the plurality of advance hydraulic chambers are formed and the working oil is supplied from the oil pump 202 to the respective retard hydraulic chambers and the respective advance hydraulic chambers, so that the pressure receiving area becomes large where the vane rotor receives hydraulic pressure on the retard side and on the advance side from the working oil in the respective retard hydraulic chambers and in the respective advance hydraulic chambers. As a result, it is possible to perform the phase control to the advance side by low hydraulic pressure even in an engine having many cylinders and hence small torque variation without receiving the auxiliary aid of torque variation that the vane rotor receives from the camshaft, as described in the patent document 2.

Further, the check valve is disposed only in the advance supply passage of the retard supply passage and the advance supply passage and hence the parts of the check valve can be reduced in number.

Still further, in the above embodiments, the check valve 80, 90, or 160 is disposed closer to the advance hydraulic chamber of the advance supply passage than the bearing 2, so that when the vane rotor receives torque variation on the retard side from the camshaft at the time of performing the phase control to the advance side, the check valve 80, 90, or 160 closes the advance supply passage at a position closer to the advance hydraulic chamber than the bearing 2. Even when the vane rotor receives torque variation on the retard side and on the advance side to vary the hydraulic pressure of the working oil in the advance hydraulic chamber, this pressure variation is not transferred to a portion which is located on the oil pump side of the check valve 80, 90, or 160 and at which the camshaft slides on the bearing 2. Hence, even when the vane rotor receives torque variation, the working oil in the advance hydraulic chamber is prevented from leaking from the portion at which the camshaft slides on the bearing 2, which can improve the responsivity of the phase control.

Still further, the switching valve 60 is disposed outside the vane rotor, the shoe housing, and the camshaft on the oil pump side of the bearing 2, which in turn prevents the vane rotor, the shoe housing, and the camshaft from being increased in size.

Other Embodiments

In the plurality of embodiments described above, the check valve for prohibiting the working oil from being discharged from the advance hydraulic chamber is disposed on the advance hydraulic chamber side of the bearing 2 of the camshaft 3, but the check valve may be disposed on the oil pump side of the bearing 2. Further, in the sixth embodiment to the fourteenth embodiment, the control valve is disposed on the advance hydraulic chamber side of the bearing 2 of the camshaft 3, but the control valve may be disposed on the oil pump side of the bearing 2.

Still further, in the plurality of embodiments described above, a construction has been employed in which the rotational driving force of the crankshaft is transferred to the camshaft by the chain sprocket, but a construction using a timing pulley, a timing gear, or the like may be employed.

Still further, it is also recommended that the vane rotor receives the driving force of the crankshaft as a driving shaft to rotate the camshaft as a driven shaft and the housing in combination.

Still further, in the sixth embodiment to the fourteenth embodiment, it is also recommended not to connect the discharge side of the advance passage having the control valve disposed therein to the advance passage on the oil pump side of the check valve but to discharge the working oil directly to the drain.

In the second, third, fifth, seventh, tenth, and eleventh embodiments, the balls 92, 162 of the check valve 90, 160 are moved in the direction of the rotary shaft of the vane rotor, but the check valve may be moved in a direction other than the direction of the rotary shaft if the check valve can allow the working oil to flow from the oil pump to the advance hydraulic chamber and can prohibit the working oil from flowing from the advance hydraulic chamber to the oil pump.

Still further, in the third embodiment, the duplicate sealing members are disposed in the peripheral direction of the outer peripheral walls of the vane 15*b* and the boss 15*d* to enhance a sealing effect, to thereby prevent the working oil from leaking from the advance hydraulic chamber 56 from which the working oil is prevented from flowing out by the check valve 90. In addition to this, for example, by enlarging the width in the peripheral direction of one sealing member, or by disposing a sealing member not only in the peripheral direction of the outer peripheral wall of the vane and the boss but also on at least one end face in the direction of the rotary shaft of the vane rotor or the housing that receives the vane rotor, it is possible to enhance the sealing effect of the sealing member of preventing the working oil from leaking from the advance hydraulic chamber from which the working oil is prevented from flowing out to the oil pump by the check valve.

In the plurality of embodiments described above, the stopper pin 32 moves in the axial direction to fit in the fitting ring 34, but a construction may be also employed in which the stopper pin moves in the radial direction to fit in the fitting ring. Further, the relative turn of the vane rotor 15 to the housing 10 is constrained by the constraining means including the stopper pin 32, the fitting ring 34, and the spring 36, but a construction may be also employed in which the valve timing controller does not include the constraining means.

What is claimed is:

1. A valve timing controller provided in a driving force transfer system for transferring a driving force from a driving shaft of an internal combustion engine to a driven shaft for opening or closing at least one of an intake valve and an exhaust valve, the valve timing controller adjusting a timing of opening or closing at least one of the intake valve and the exhaust valve, the valve timing controller comprising:

a housing including a plurality of receiving chambers that rotate along with one of the driving shaft and the driven shaft, the receiving chambers being arranged in a direction of rotation within a predetermined angle;

a vane rotor that rotates with the other of the driving shaft and the driven shaft, the vane rotor having vanes respectively received in the receiving chambers, each of vanes being turned toward a retard side and toward an advance side relative to the housing by pressure of a working fluid in a plurality of retard hydraulic chambers and advance hydraulic chambers formed by partitioning the respective receiving chambers by the vanes;

a retard passage for supplying the working fluid from a fluid supply source to the respective retard hydraulic chambers;

a first advance passage for supplying the working fluid from the fluid supply source to the respective advance hydraulic chambers;

a check valve disposed in a first advance passage, the check valve allowing a flow of the working fluid from the fluid supply source to the advance hydraulic chamber, the check valve prohibiting a flow of the working fluid from the advance hydraulic chamber to the fluid supply source;

a second advance passage for discharging the working fluid in the advance hydraulic chamber, wherein the second advance passage discharges the working fluid in the advance hydraulic chamber when the fluid supply source supplies the working fluid into the retard hydraulic chambers; and a control valve that is disposed in the second advance passage and opens the second advance passage when valve timing is controlled to a retard side and closes the second advance passage when valve timing is controlled to an advance side.

2. The valve timing controller as claimed in claim 1, wherein the number of the retard hydraulic chambers and the number of the advance hydraulic chambers are three or more, respectively.

3. The valve timing controller as claimed in claim 1, wherein the check valve is disposed in the first advance passage for supplying the working fluid to only one of the plurality of advance hydraulic chambers.

4. The valve timing controller as claimed in claim 3, wherein a sealing effect of a sealing member for preventing the working fluid from flowing out of the advance hydraulic chamber, from which the working fluid is prohibited from flowing to the fluid supply source by the check valve, is made greater than other advance hydraulic chambers.

5. The valve timing controller as claimed in claim 1, wherein the retard passage, the first advance passage, and the second advance passage connect with the retard hydraulic chamber or the advance hydraulic chamber through a bearing of the driven shaft and the driven shaft, and wherein the check valve is disposed closer to an advance hydraulic chamber of the first advance passage than the bearing.

6. The valve timing controller as claimed in claim 1, further comprising: a switching valve for switching supply of the working fluid to the retard hydraulic chambers and the advance hydraulic chambers and discharge of the working fluid from the retard hydraulic chambers and the advance hydraulic chambers, wherein the retard passage, the first advance passage, and the second advance passage connect with the retard hydraulic chamber or the advance hydraulic chamber through a bearing of the driven shaft and the driven shaft, and wherein the switching valve is disposed closer to the working fluid supply source than the bearing.

7. The valve timing controller as claimed in claim 1, wherein the check valve is disposed in the vane rotor.

8. The valve timing controller as claimed in claim 7, wherein the check valve moves in a direction of a rotary shaft of the vane rotor.

9. The valve timing controller as claimed in claim 1, wherein the control valve has a valve element for opening or closing the second advance passage, the valve element being opened or closed by at least one of pressure of the working fluid in the retard passage and pressure of the working fluid closer to the fluid supply source than the check valve of the first advance passage.

10. The valve timing controller as claimed in claim 1, wherein the retard passage and the first advance passage connect through a bearing of the driven shaft and the driven shaft with the retard hydraulic chamber or the advance hydraulic chamber, and the control valve is disposed closer to the advance hydraulic chamber than the bearing.

11. A valve timing controller provided in a driving force transfer system for transferring a driving force from a driving shaft of an internal combustion engine to a driven shaft for opening or closing at least one of an intake valve and an exhaust valve, the valve timing controller adjusting a timing of opening or closing at least one of the intake valve and the exhaust valve, the valve timing controller comprising:

a housing including a plurality of receiving chambers that rotate along with one of the driving shaft and the driven shaft, the receiving chambers being arranged in a direction of rotation within a predetermined angle;

a vane rotor that rotates with the other of the driving shaft and the driven shaft, the vane rotor having vanes respectively received in the receiving chambers, each of vanes being turned toward a retard side and toward an advance side relative to the housing by pressure of a working fluid in a plurality of retard hydraulic chambers and advance hydraulic chambers formed by partitioning the respective receiving chambers by the vanes;

a retard passage for supplying the working fluid from a fluid supply source to the respective retard hydraulic chambers;

a first advance passage for supplying the working fluid from the fluid supply source to the respective advance hydraulic chambers;

a check valve disposed in a first advance passage, the check valve allowing a flow of the working fluid from the fluid supply source to the advance hydraulic chamber, the check valve prohibiting a flow of the working fluid from the advance hydraulic chamber to the fluid supply source, and a second advance passage for discharging the working fluid in the advance hydraulic chamber, wherein the second advance passage discharges the working fluid in the advance hydraulic chamber when the fluid supply source supplies the working fluid into the retard hydraulic chambers, wherein the retard passage, the first advance passage, and the second advance passage connect with the retard hydraulic chamber or the advance hydraulic chamber through a bearing of the driven shaft and the driven shaft, and wherein the check valve is disposed closer to an advance hydraulic chamber of the first advance passage than the bearing.

12. The valve timing controller as claimed in claim 11, wherein the number of the retard hydraulic chambers and the number of the advance hydraulic chambers are three or more, respectively.

13. The valve timing controller as claimed in claim 11, wherein the check valve is disposed in the first advance passage for supplying the working fluid to only one of the plurality of advance hydraulic chambers.

14. The valve timing controller as claimed in claim 13, wherein a sealing effect of a sealing member for preventing the working fluid from flowing out of the advance hydraulic chamber, from which the working fluid is prohibited from flowing to the fluid supply source by the check valve, is made greater than other advance hydraulic chambers.

15. The valve timing controller as claimed in claim 11, further comprising: a switching valve for switching supply of the working fluid to the retard hydraulic chambers and the advance hydraulic chambers and discharge of the working fluid from the retard hydraulic chambers and the advance hydraulic chambers, wherein the retard passage, the first advance passage, and the second advance passage connect with the retard hydraulic chamber or the advance hydraulic chamber through a bearing of the driven shaft and the driven shaft, and wherein the switching valve is disposed closer to the working fluid supply source than the bearing.

16. The valve timing controller as claimed in claim 11, wherein the check valve is disposed in the vane rotor.

17. The valve timing controller as claimed in claim 16, wherein the check valve moves in a direction of a rotary shaft of the vane rotor.

18. A valve timing controller provided in a driving force transfer system for transferring a driving force from a driving shaft of an internal combustion engine to a driven shaft for opening or closing at least one of an intake valve and an exhaust valve, the valve timing controller adjusting a timing of opening or closing at least one of the intake valve and the exhaust valve, the valve timing controller comprising:

a housing including a plurality of receiving chambers that rotate along with one of the driving shaft and the driven shaft, the receiving chambers being arranged in a direction of rotation within a predetermined angle;

a vane rotor that rotates with the other of the driving shaft and the driven shaft, the vane rotor having vanes respectively received in the receiving chambers, each of vanes being turned toward a retard side and toward an advance side relative to the housing by pressure of a working fluid in a plurality of retard hydraulic chambers and advance hydraulic chambers formed by partitioning the respective receiving chambers by the vanes;

a retard passage for supplying the working fluid from a fluid supply source to the respective retard hydraulic chambers;

a first advance passage for supplying the working fluid from the fluid supply source to the respective advance hydraulic chambers;

a check valve disposed in a first advance passage, the check valve allowing a flow of the working fluid from the fluid supply source to the advance hydraulic chamber, the check valve prohibiting a flow of the working fluid from the advance hydraulic chamber to the fluid supply source;

a second advance passage for discharging the working fluid in the advance hydraulic chamber, wherein the second advance passage discharges the working fluid in the advance hydraulic chamber when the fluid supply source supplies the working fluid into the retard hydraulic chambers; and a switching valve for switching supply of the working fluid to the retard hydraulic chambers and the advance hydraulic chambers and discharge of the working fluid from the retard hydraulic chambers and the advance hydraulic chambers, wherein the retard passage, the first advance passage, and the second advance passage connect with the retard hydraulic chamber or the advance hydraulic chamber through a bearing of the driven shaft and the driven shaft, and wherein the switching valve is disposed closer to the working fluid supply source than the bearing.

19. The valve timing controller as claimed in claim 18, wherein the number of the retard hydraulic chambers and the number of the advance hydraulic chambers are three or more, respectively.

20. The valve timing controller as claimed in claim 18, wherein the check valve is disposed in the first advance passage for supplying the working fluid to only one of the plurality of advance hydraulic chambers.

21. The valve timing controller as claimed in claim 20, wherein a sealing effect of a sealing member for preventing the working fluid from flowing out of the advance hydraulic chamber, from which the working fluid is prohibited from flowing to the fluid supply source by the check valve, is made greater than other advance hydraulic chambers.

22. The valve timing controller as claimed in claim 18, wherein the check valve is disposed in the vane rotor.

23. The valve timing controller as claimed in claim 22, wherein the check valve moves in a direction of a rotary shaft of the vane rotor.

* * * * *